US008251682B2

(12) United States Patent
Hasegawa et al.

(10) Patent No.: US 8,251,682 B2
(45) Date of Patent: Aug. 28, 2012

(54) MULTI STAGE ROTARY EXPANDER AND REFRIGERATION CYCLE APPARATUS WITH THE SAME

(75) Inventors: Hiroshi Hasegawa, Osaka (JP); Masaru Matsui, Kyoto (JP); Atsuo Okaichi, Osaka (JP); Tomoichiro Tamura, Kyoto (JP); Takeshi Ogata, Osaka (JP)

(73) Assignee: Panasonic Corporation, Osaka (JP)

( * ) Notice: Subject to any disclaimer, the term of this patent is extended or adjusted under 35 U.S.C. 154(b) by 904 days.

(21) Appl. No.: 11/916,609

(22) PCT Filed: May 12, 2006

(86) PCT No.: PCT/JP2006/309557

§ 371 (c)(1),
(2), (4) Date: Jan. 8, 2009

(87) PCT Pub. No.: WO2006/132053

PCT Pub. Date: Dec. 14, 2006

(65) Prior Publication Data

US 2009/0229302 A1 Sep. 17, 2009

(30) Foreign Application Priority Data

Jun. 8, 2005 (JP) ..... 2005-167950

(51) Int. Cl.
*F03C 2/00* (2006.01)
*F03C 4/00* (2006.01)
*F04C 11/00* (2006.01)

(52) U.S. Cl. ..... 418/11; 418/60; 418/154; 418/270; 417/310; 417/902

(58) Field of Classification Search ..... 418/11, 418/60, 63, 270, 3, 152, 154, 155; 417/310, 417/902
See application file for complete search history.

(56) References Cited

U.S. PATENT DOCUMENTS 5,616,019 A 4/1997 Hattori et al.

FOREIGN PATENT DOCUMENTS

JP 5-149281 6/1993

(Continued)

OTHER PUBLICATIONS

"Strategic Development of Technology for Efficient Energy Utilization—Development of Two Phase Flow Expander/Compressor for a $CO_2$ Air Conditioner", issued by New Energy and Industrial Technology Development Organization, Mar. 2004.

*Primary Examiner* — Theresa Trieu
(74) *Attorney, Agent, or Firm* — Hamre, Schumann, Mueller & Larson, P.C.

(57) ABSTRACT

An integrally formed vane (301) is disposed slidably in a vane groove (205*a*) of a first cylinder (205) and a vane groove (206*a*) of a second cylinder (206). A cut-out (301*a*) with a width substantially equal to the thickness of an intermediate plate (304) is provided in the vane (301), which is divided by this cut-out (301*a*) into a first vane portion (301*b*) whose leading end makes contact with a first piston (209) at its leading end and a second vane portion (301*c*) whose leading end makes contact with a second piston (210). This configuration allows the first vane portion (301*b*) to be pushed toward the first piston (209) side by the pressure difference acting on the second vane portion (301*c*) and makes it possible to keep a contact state between the first vane portion (301*b*) and the first piston (209), even when no pushing force toward the first piston (209) side that results from the pressure difference acts on the first vane portion (301*b*).

10 Claims, 29 Drawing Sheets

FOREIGN PATENT DOCUMENTS

| | | | | |
|---|---|---|---|---|
| JP | 8-338356 | 12/1996 | | |
| JP | 11-22678 | 1/1999 | | |
| JP | 2003-343467 | 12/2003 | | |
| JP | 2005106046 | A | * | 4/2005 |
| JP | 2005265278 | A | * | 9/2005 |

* cited by examiner

MULTI STAGE ROTARY EXPANDER AND REFRIGERATION CYCLE APPARATUS WITH THE SAME

FIELD OF THE INVENTION

The present invention relates to an expander that produces mechanical forces or electric power by recovering the energy of expansion of a high pressure compressible fluid. More particularly, the invention relates to an expander that recovers the energy of expansion of a refrigerant in place of a throttling mechanism in a refrigeration cycle. The invention also relates to a refrigeration cycle apparatus having the expander.

BACKGROUND ART

A rotary type expander has been known as an expander used for the purpose of recovering the energy of expansion of the refrigerant of a refrigeration cycle apparatus when it expands.

The configuration of a conventional rotary type expander as described in JP 8-338356 A will be described below. For simplicity in illustration, the expander of one piston type will be described.

FIG. 14 is a vertical cross-sectional view illustrating the configuration of a conventional rotary type expander 100, and FIG. 15 is a horizontal cross-sectional view of the expander shown in FIG. 14, taken along line D1-D1. A power generator 101 includes a stator 101*a* fixed to a closed casing 102 and a rotor 101*b* fixed to a shaft 103 and generates an electromotive force between the rotor 101*b* and a coil of the stator 101*a* by rotation of the rotor 101*b* to obtain electric power. The shaft 103 penetrates through a cylinder 104 and is supported rotatably by bearings 105, 106. The shaft 103 is provided with an eccentric portion 103*a*. A piston 107 disposed in the interior of the cylinder 104 is fitted to the eccentric portion 103*a*. Inside the shaft 103, an axially extending flow passage 103*b* is provided along the axis of the shaft 103, and a radially extending flow passage 103*d* connecting the axially extending flow passage 103*b* and an opening portion 103*c* is provided in the eccentric portion 103*a*.

As illustrated in FIG. 15, a fitting groove 107*a* is formed in the outer circumferential surface of the piston 107, while a vane groove 104*a* is formed in the cylinder 104. A vane 108, which is supported reciprocably by the vane groove 104*a*, is fitted to the fitting groove 107*a* at its leading end, and it is firmly in contact with the piston 107 at all times by a force resulting from a spring 109 and a force resulting from the pressure difference between the leading end side and the back side of the vane 108. A crescent-shaped space formed by the cylinder 104 and the piston 107 is divided into two working chambers 110*a* and 110*b* by the vane 108. An intake port 107*b* provided in the piston 107 is connected to the working chamber 110*a*, and a discharge port 104*b* provided in the cylinder 104 is connected to the working chamber 110*b*.

A high pressure working fluid flows into the interior of the closed casing 102 through an intake pipe 111, passes through the axially extending flow passage 103*b* and the radially extending flow passage 103*d* of the shaft 103, and thereafter reaches the opening portion 103*c*. The opening portion 103*c* rotates along with the rotational motion of the shaft 103, while the piston 107 performs an eccentric rotational motion that does not accompany self rotation, in other words, what is called a swing motion. As a result, the intake port 107*b* provided in the piston 107 and the opening portion 103*c* provided in the eccentric portion 103*a* are connected and disconnected repeatedly along with the rotational motion of the shaft 103. While the opening portion 103*c* and the intake port 107*b* are being connected, the working fluid is taken into the working chamber 110*a*. Thereafter, when the opening portion 103*c* and the intake port 107*b* are disconnected, an intake stroke finishes. The working fluid expands with the pressure lowering, and rotates the shaft 103 in a direction in which the internal volume of the working chamber 110*a* enlarges, thus driving the power generator 101. As the shaft 103 rotates, the working chamber 110*a* shifts to the working chamber 110*b*, and when it connects with the discharge port 104*b*, an expansion stroke finishes. The working fluid, the pressure of which has been lowered, is discharged through the discharge port 104*b* to a discharge pipe 112.

The principle by which the vane 108 can make contact firmly with the piston 107 will be described. FIG. 16 is an enlarged horizontal cross-sectional view taken along line D1-D1 of the expander shown in FIG. 14. Referring to FIG. 16, the piston 107 is at what is called the top dead center, and the vane 108 is in such a condition that it is pressed into the vane groove 104*a* most inwardly. Reference characters A and B designate edges formed by the round surface on the leading end side and the side faces of the vane 108, and C and D designate edges formed by the back surface and the side faces of the vane 108. The radius of the round surface on the leading end side of the vane 108 is smaller than the radius of the fitting groove 107*a* of the piston 107, and therefore, the round surface on the leading end side of the vane 108 makes contact with the fitting groove 107*a* of the piston 107 at a point E. The surfaces AE, BE on the leading end side of the vane 108 face the space connected to the working chamber 110*a*. Accordingly, the pressure that acts on the round surface on the leading end side of the vane 108 (i.e., the surface AB) is the pressure in the working chamber 110*a*. The pressure in the working chamber 110*a* equals a discharge pressure Pd because the working chamber 110*a* is connected to the discharge port 104*b*. On the other hand, the pressure that acts on the back surface CD of the vane 108 is the internal pressure in the closed casing 102, which always equals a suction pressure Ps. Accordingly, because of the pressure difference therebetween, the vane 108 receives a force in a direction such that it is brought into firm contact with the piston 107. At the top dead center, the direction of motion of the vane 108 reverses from the direction inwardly of the vane groove 104*a* to the direction outwardly thereof, and therefore, the inertial force acting on the vane 108 works in a direction in which the leading end of the vane 108 comes off from the piston 107. However, because of the force resulting from the pressure difference, the vane 108 is allowed to be firmly in contact with the piston 107 with a sufficient margin.

The spring 109 is an auxiliary component for bringing the vane 108 into firm contact with the piston 107 until the pressure difference between the suction pressure Ps and the discharge pressure Pd is produced upon starting. Assuming that the expander is the one used for the refrigeration cycle using carbon dioxide as the working fluid and the vane 108 is made of steel with a height of 10 mm, a width of 4 mm, and a length of 20 mm, wherein the suction pressure Ps is 100 kgf/cm$^2$ and the discharge pressure Pd is 50 kgf/cm$^2$, then the force acting on the vane 108 by the pressure difference is 20 kgf. In addition, assuming that the spring 109 is a coil spring in which its maximum bending amount is 6 mm and the outer diameter thereof is 4 mm, which is the same as the width of the vane 108, the spring force is about 0.3 kgf since the spring constant of a spring of this class is 0.05 kgf/mm at best. On the other hand, when the vane 108 undergoes a simple harmonic motion at 90 Hz with an amplitude of 3 mm, the inertial force is about 0.6 kgf. Thus, it will be understood that, especially when operated at high speed, such as at 90 Hz, the force of the spring 109 is smaller than the inertial force of the reciprocating motion of the vane 108 and the force pressing the vane 108 toward the piston 107 by the pressure difference is required.

Next, the configuration of a conventional rotary type expander, such as the one shown in "Strategic Development of Technology for Efficient Energy Utilization—Development of Two Phase Flow Expander/Compressor for a $CO_2$ Air Conditioner," a report issued in March 2004 by the New Energy and Industrial Technology Development Organization, will be described below. It should be noted that the rotary type expander shown in the just-mentioned report has the same fundamental configuration as that of the compressor shown in JP 2003-343467 A, although the flow of the refrigerant and the direction of rotation of the shaft are opposite.

FIG. 17 is a vertical cross-sectional view illustrating the configuration of a conventional rotary type expander 200. FIG. 18A is a horizontal cross-sectional view of the expander shown in FIG. 17, taken along line D2-D2. FIG. 18B is a horizontal cross-sectional view of the expander shown in FIG. 17, taken along line D3-D3. A power generator 201 includes a stator 201*a* fixed to a closed casing 202 and a rotor 201*b* fixed to a shaft 203. The shaft 203 penetrates through a first cylinder 205 and a second cylinder 206 that are partitioned by an intermediate plate 204 so as to be independent of each other, and is supported rotatably by bearings 207, 208. A first eccentric portion 203*a* and a second eccentric portion 203*b* that are off-centered in the same direction with respect to the axis of the shaft 203 are provided vertically along the axis of the shaft 203. A first piston 209 disposed in the interior of the first cylinder 205 is fitted to the first eccentric portion 203*a*. A second piston 210 disposed in the interior of the second cylinder 206 is fitted to the second eccentric portion 203*b*.

The heights and diameters of the first cylinder 205 and the first piston 209 as well as the second cylinder 206 and the second piston 210 are set so that the crescent-shaped space formed by the first cylinder 205 and the first piston 209 becomes smaller than the crescent-shaped space formed by the second cylinder 206 and the second piston 210. In the example shown in FIG. 17, the inner diameter of the first cylinder 205 and the inner diameter of the second cylinder 206 are equal to each other, the outer diameter of the first piston 209 and the outer diameter of the second piston 210 are equal to each other, and the height of the second cylinder 206 is greater than the height of the first cylinder 205. This configuration is followed also in some of the embodiments of the present invention.

As illustrated in FIGS. 18A and 18B, vane grooves 205*a* and 206*a* are formed in the first cylinder 205 and the second cylinder 206, respectively. A first vane 211 and a second vane 212 are supported reciprocably by the vane groove 205*a* and 206*a*, respectively. Each of them is brought into firm contact with the respective pistons 209 and 210 by a force resulting from springs 213 and 214 and a force resulting from the pressure difference between the leading end side and the back side of the vanes 211 and 212. A crescent-shaped space formed by the first cylinder 205 and the first piston 209 is divided into working chambers 215*a*, 215*b* by the first vane 211. Likewise, a crescent-shaped space formed by the second cylinder 206 and the second piston 210 is divided into working chambers 216*a*, 216*b* by the second vane 212. An intake port 205*b* (intake passage) provided in the first cylinder 205 is connected to the working chamber 215*a* (first intake-side space). The working chamber 215*b* (first discharge-side space) and the working chamber 216*a* (second intake-side space) are connected by a through hole 204*a* (connecting passage) provided in the intermediate plate 204 so as to pass in between the first vane 211 and the second vane 212 diagonally, to form a single space. A discharge port 206*b* (discharge passage) provided in the second cylinder 206 is connected to the working chamber 216*b* (second discharge-side space).

A high pressure working fluid flows into the interior of the closed casing 202 through an intake pipe 217, and is taken into the working chamber 215*a* of the first cylinder 205 through the intake port 205*b*. The internal volume of the working chamber 215*a* increases according to the rotational motion of the shaft 203, shifting to the working chamber 215*b* that is connected to the through hole 204*a*, and an intake stroke finishes. The working chamber 215*b* connects with the working chamber 216*a* of the second cylinder 206 through the through hole 204*a*, forming a single working chamber. The high pressure working fluid rotates the shaft 203 in a direction in which the internal volume of the working chamber connected as a whole increases, in other words, in a direction in which the internal volume of the working chamber 215*b* decreases but the internal volume of the working chamber 216*a* increases, to drive the power generator 201. As the shaft 203 rotates, the working chamber 215*b* disappears, the working chamber 216*a* shifts to the working chamber 216*b*, and an expansion stroke finishes. The working fluid whose pressure has been lowered is discharged through the discharge port 206*b* to the discharge pipe 218.

In FIGS. 18A and 18B, which has been referred to in the description above, the rotational positions of the respective vane grooves 205*a*, 206*a* of the first cylinder 205 and the second cylinder 206 are the same, but this is not always necessary. FIG. 19 is a vertical cross-sectional view illustrating the configuration of a conventional rotary type expander 400 when the vane grooves 205*a*, 206*a* are at different rotational positions. FIG. 20A is a horizontal cross-sectional view of the expander shown in FIG. 19, taken along line D4-D4. FIG. 20B is a horizontal cross-sectional view of the expander shown in FIG. 19, taken along line D5-D5. The term "rotational position" herein refers to an angular position around the shaft 203.

The position of the vane groove 205*a* of the first cylinder 205 is rotated about 30 degrees with respect to the vane groove 206*a* of the second cylinder 206. By doing so, the through hole 204*a* to be provided in the intermediate plate 204 can be provided perpendicular to the intermediate plate 204, and moreover, the intermediate plate 204 does not need to be made thick for providing the diagonal through hole 204*a*. This makes it possible to reduce the internal volume of the through hole 204*a* significantly and lower the amount of the working fluid remaining the through hole 204*a*, thereby preventing the efficiency decrease.

The principle by which the first vane 211 and the second vane 212 are brought into firm contact with the first piston 209 and the second piston 210, respectively, will be described below. FIG. 21A is a horizontal cross-sectional view of the expander shown in FIG. 17, taken along line D2-D2, and FIG. 21B is a horizontal cross-sectional view of the expander shown in FIG. 17, taken along line D3-D3.

Referring to FIG. 21A, the first piston 209 is at what is called the top dead center, and the first vane 211 is positioned so that it is pressed into the inward most part of the vane groove 205*a*. Reference characters A and B designate edges formed by the round surface on the leading end side and the side faces of the first vane 211, and C and D designate edges formed by the back surface and the side faces of the first vane 211. The round surface of the leading end side of the first vane 211 makes contact with the first piston 209 at a point E. The pressure that acts on the round surface on the leading end side of the first vane 211 is the pressure in the working chamber 215*a*. The pressure in the working chamber 215*a* equals the suction pressure Ps because the working chamber 215*a* is connected to the intake port 205*b*. On the other hand, the pressure that acts on the back surface CD of the first vane 211 is the internal pressure in the closed casing 102, which always equals the suction pressure Ps. Accordingly, there is no pressure difference between the leading end side and the back side of the first vane 211, and the force resulting from pressure difference, which causes the first vane 211 to bring into firm contact with the first piston 209, does not act on the first piston 209. At the top dead center, the direction of motion of the first vane 211 reverses from the direction inwardly of the vane groove 205*a* to the direction outwardly thereof, and therefore, the inertial force acting on the first vane 211 works in a direction in which the leading end of the first vane 211 comes off from the first piston 209. However, since no force resulting from the pressure difference works, it is necessary to press the first vane 211 by a spring 213 so as not to move away from the first piston 209. As will be appreciated from the fact that the inertial force of the vane 108 was found to be greater than the force of the spring 109 in the trial calculation for the inertial force of the vane 108 and the force of the spring 109 in the conventional rotary type expander 100 shown in FIGS. 14 to 16, the force of the spring 213 is not necessarily sufficient for bringing the first vane 211 into firm contact with the first piston 209. For this reason, it is necessary to design the first vane 211 to have a smaller mass so that the inertial force of the first vane 211 becomes smaller than the force of the spring 213, for example, by changing the material for the first vane 211 from steel to carbon or by making the shape thereof smaller. In another way, as illustrated in FIG. 22, it is possible to employ the configuration in which the vane cannot be separated from the piston by using a swing piston 219 in which the vane is integrally formed with the piston.

On the other hand, referring to FIG. 21B, the second piston 210 is at what is called the top dead center, and the second vane 212 is positioned so that it is pressed into the inward most part of the vane groove 206*a*. Reference characters A and B designate edges formed by the round surface on the leading end side and the side faces of the second vane 212, and C and D designate edges formed by the back surface and the side faces of the second vane 212. The round surface of the leading end side of the second vane 212 makes contact with the second piston 210 at a point E. The pressure that acts on the round surface on the leading end side AB of the second vane 212 is the pressure in the working chamber 216*b*. The pressure in the working chamber 216*b* equals the discharge pressure Pd because the working chamber 216*b* is connected to the discharge port 206*b*. On the other hand, the pressure that acts on the back surface CD of the second vane 212 is the internal pressure in the closed casing 202, which always equals the suction pressure Ps. Accordingly, because of the pressure difference therebetween, the second vane 212 receives a force in a direction such that it is brought into firm contact with the second piston 210. At the top dead center, the direction of motion of the second vane 212 reverses from the direction inwardly of the vane groove 206*a* to the direction outwardly thereof, and therefore, the inertial force acting on the second vane 212 works in a direction in which the leading end of the second vane 212 comes off from the second piston 210. However, because of the force resulting from the pressure difference, the second vane 212 is allowed to be firmly in contact with the second piston 210 with a sufficient margin. As in the expander shown in JP 8-338356 A, the spring 214 is an auxiliary component for bringing the second vane 212 into firm contact with the second piston 210 until the pressure difference between the suction pressure Ps and the discharge pressure Pd is produced upon starting.

DISCLOSURE OF THE INVENTION

However, the following problems have arisen with the conventional rotary type expanders shown in FIGS. 17 to 21. The pressing force resulting from the pressure difference acting on the leading end side of and the back side of the first vane is not obtained, so the leading end of the vane comes off from the piston because of the inertial force acting on the vane except when the mass thereof is made particularly smaller by using materials such as aluminum and carbon. This results in leakage of the working fluid, leading to significant performance deterioration. In some cases, the working chambers may fail to be formed and the expander may fail to function.

In addition, the problems of higher material costs and reliability deterioration because of the sliding between the first vane and the vane groove have arisen when the first vane is made of aluminum or carbon for the purpose of reducing the weight.

Also, the problem of higher processing cost has arisen when employing the swing piston as shown in FIG. 22 that is finished with the same processing accuracy as the conventional pistons and vanes.

The present invention has been accomplished in view of the foregoing circumstance. It is an object of the invention to provide a multi-stage rotary type expander that prevents leakage of the working fluid and makes stable operations as an expander possible by preventing the leading end of the first vane from being separated from the piston without accompanying reliability deterioration or higher material costs of the vane, or higher processing cost such as with the swing piston, and thus provide a highly efficient, low-cost, and highly reliable multi-stage rotary type expander. The invention also provides a refrigeration cycle apparatus having the expander.

Accordingly, the present invention provides a multi-stage rotary type expander including:

a shaft having a first eccentric portion and a second eccentric portion vertically along its axis;

a first piston attached to the first eccentric portion and performing eccentric rotational motion;

a first cylinder disposed such that a portion of an inner surface thereof is in contact with the first piston;

a first vane disposed reciprocably in a first vane groove provided in the first cylinder, the first vane dividing, by a leading end thereof being in contact with the first piston, a space between the first cylinder and the first piston into a first intake-side space and a first discharge-side space;

a second piston attached to the second eccentric portion and performing eccentric rotational motion;

a second cylinder disposed such that a portion of an inner surface thereof is in contact with the second piston;

a second vane disposed reciprocably in a second vane groove provided in the second cylinder, the second vane dividing, by a leading end thereof being in contact with the second piston, a space between the second cylinder and the second piston into a second intake-side space and a second discharge-side space, and receiving a force toward the second piston produced by a high-pressure atmosphere outside the second cylinder;

an intake passage for allowing a working fluid before expansion to be taken into the first intake-side space;

a connecting passage for forming a working chamber, the connecting passage connecting the first discharge-side space and the second intake-side space, wherein the working fluid expands in the working chamber; and a discharge passage for allowing the working fluid after expansion to be discharged from the second discharge-side space, wherein the second vane applies to the first vane a force in a direction toward the first piston when the second vane moves toward the second piston side.

The just-described multi-stage rotary type expander according to the present invention (hereinafter also simply referred to as an "expander") follows the fundamental configuration of the rotary type expander illustrated in FIG. 17. The working fluid is expanded in the single working chamber (expansion chamber) including a discharge-side working chamber (first discharge-side space) in the first cylinder and the intake-side working chamber (second intake-side space) in the second cylinder. When the second vane moves toward the second piston side, the second vane applies a force in a direction toward the first piston to the first vane, so the first vane is pressed to the first piston in cooperation with the second vane. In other words, the shortage of the force to be applied to the first vane is supplemented by the excessive force applied to the second vane. Thereby, it is possible to keep the contact state between the first vane and the first piston even when there is no pressure difference between the leading end side and the rear end side of the first vane.

Thus, the expander according to the present invention can prevent the leading end of the first vane from being separated from the first piston without accompanying reliability deterioration or material cost increases of the vane or processing cost increases such as with the swing piston. This enables stable operations as an expander and realizes a highly efficient, low cost, and highly reliable expander.

BRIEF DESCRIPTION OF THE DRAWINGS

FIG. 11B is a horizontal cross-sectional view of the expander shown in

FIG. 10, taken along line D5-D5.

BEST MODE FOR CARRYING OUT THE INVENTION

Hereinbelow, preferred embodiments of the present invention are described with reference to the drawings.

(Embodiment 1)

Figure 1A:
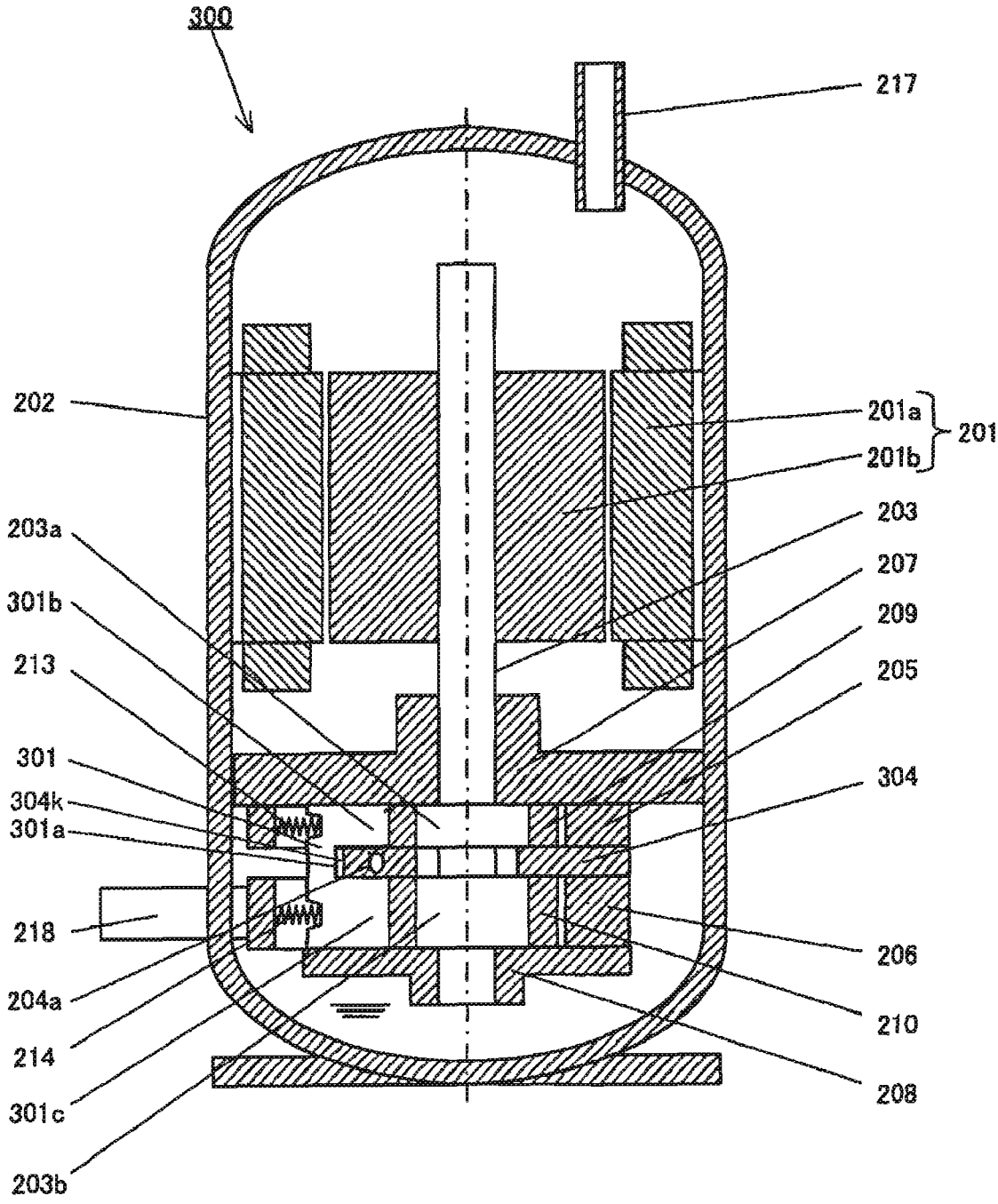
FIG. 1A is a vertical cross-sectional view illustrating an expander according to Embodiment 1 of the present invention.
Figure 17:
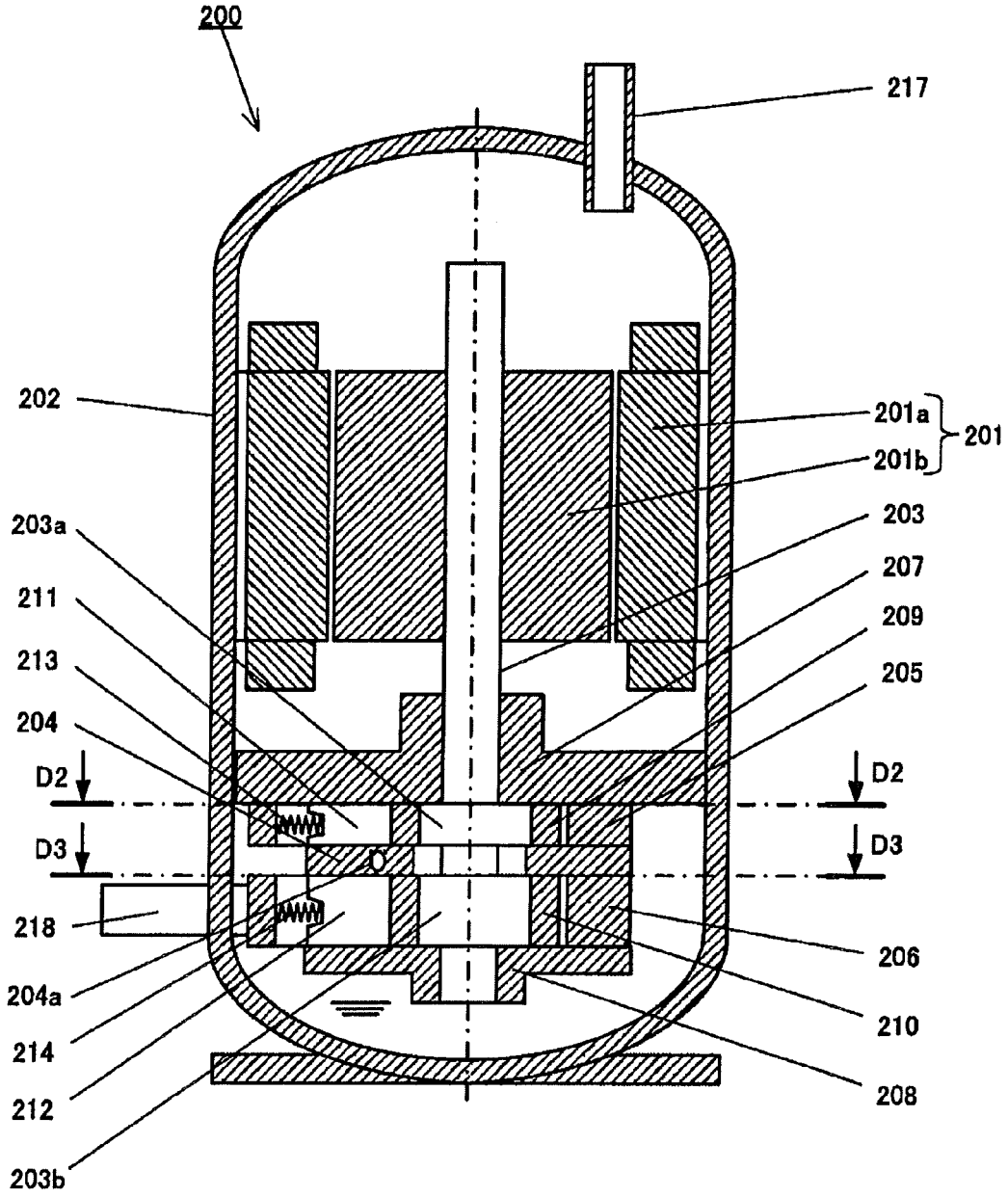
FIG. 17 PRIOR ART
FIG. 17 is a vertical cross-sectional view illustrating a conventional expander.
Figure 18A:
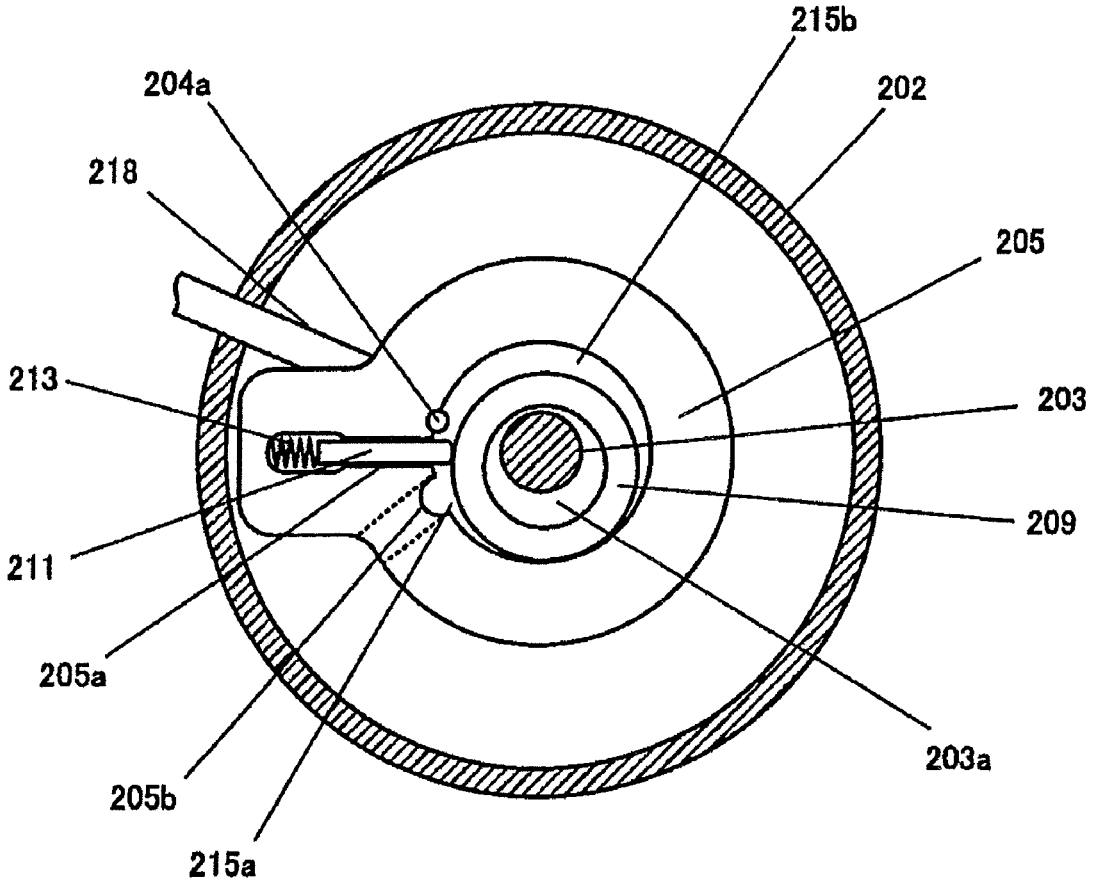
FIG.18A PRIOR ART
FIG. 18A is a horizontal cross-sectional view of the expander shown in FIG. 17, taken along line D2-D2.
Figure 18B:
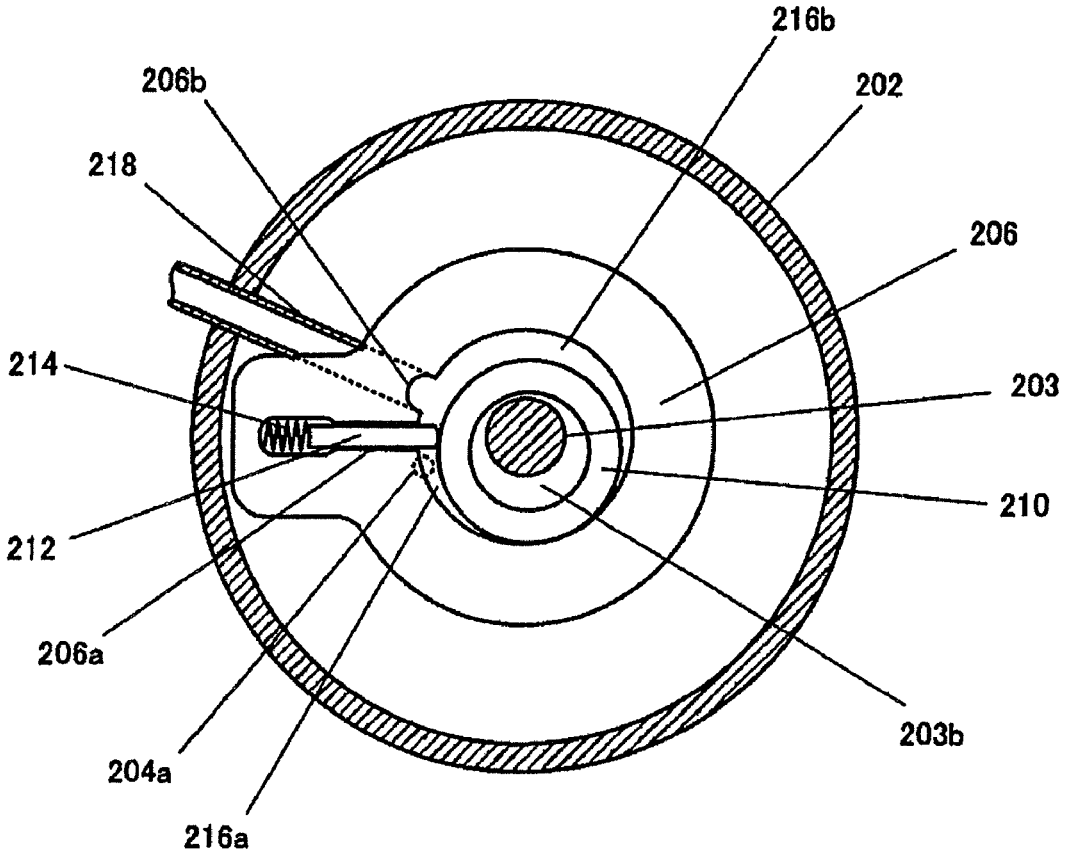
FIG.18B PRIOR ART
FIG. 18B is a horizontal cross-sectional view of the expander shown in FIG. 17, taken along line D3-D3.
Figure 21A:
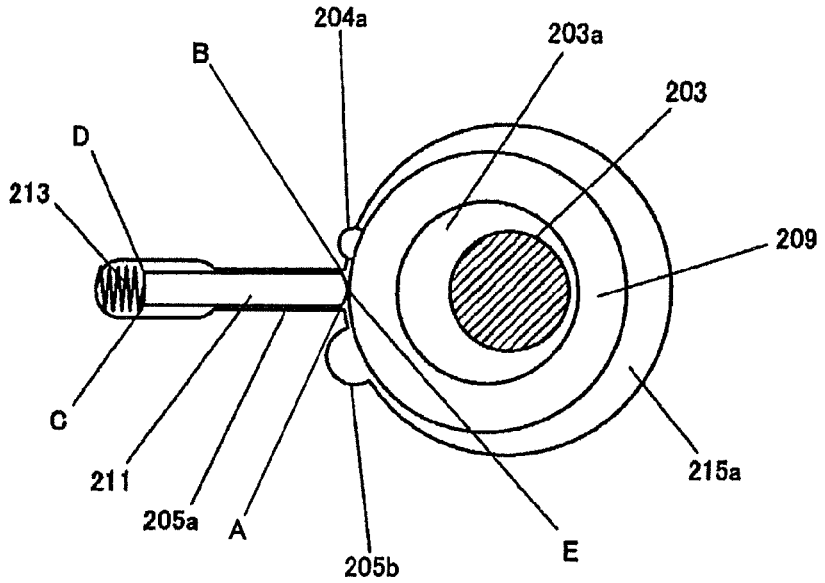
PRIOR ART FIG.21A
FIG. 21A is an enlarged horizontal cross-sectional view of the expander shown in FIG. 17, taken along line D2-D2.
Figure 21B:
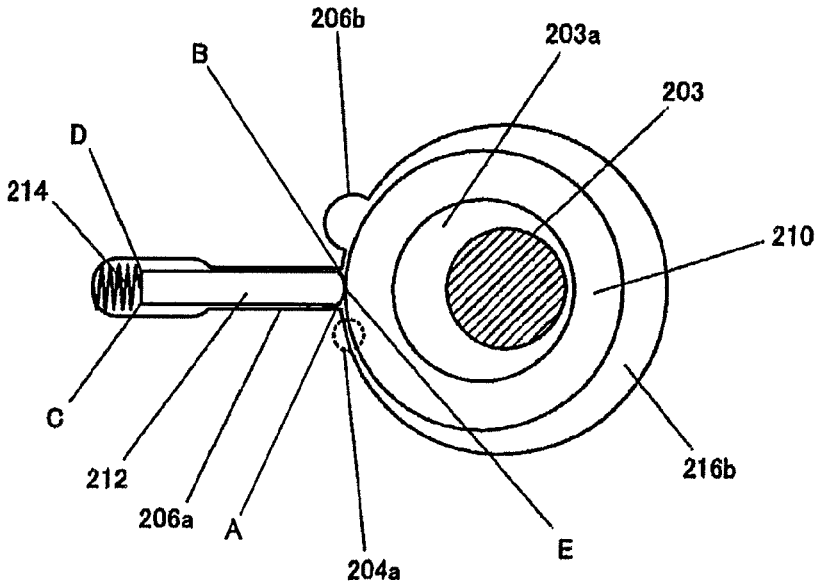
FIG.21B PRIOR ART
FIG. 21B is an enlarged horizontal cross-sectional view of the expander shown in FIG. 17, taken along line D3-D3.

FIG. 1A is a vertical cross-sectional view illustrating an expander 300 according to Embodiment 1 of the present invention. The configuration of the expander 300 of the present embodiment 1 is the same as that of the conventional rotary type expander 200 that has been illustrated with reference to FIGS. 17, 18, and 21, except for the vanes and the intermediate plate. The same functional components are designated by the same reference numerals, and the descriptions of the same configurations and workings as those of the conventional examples will be omitted.

Figure 1B:
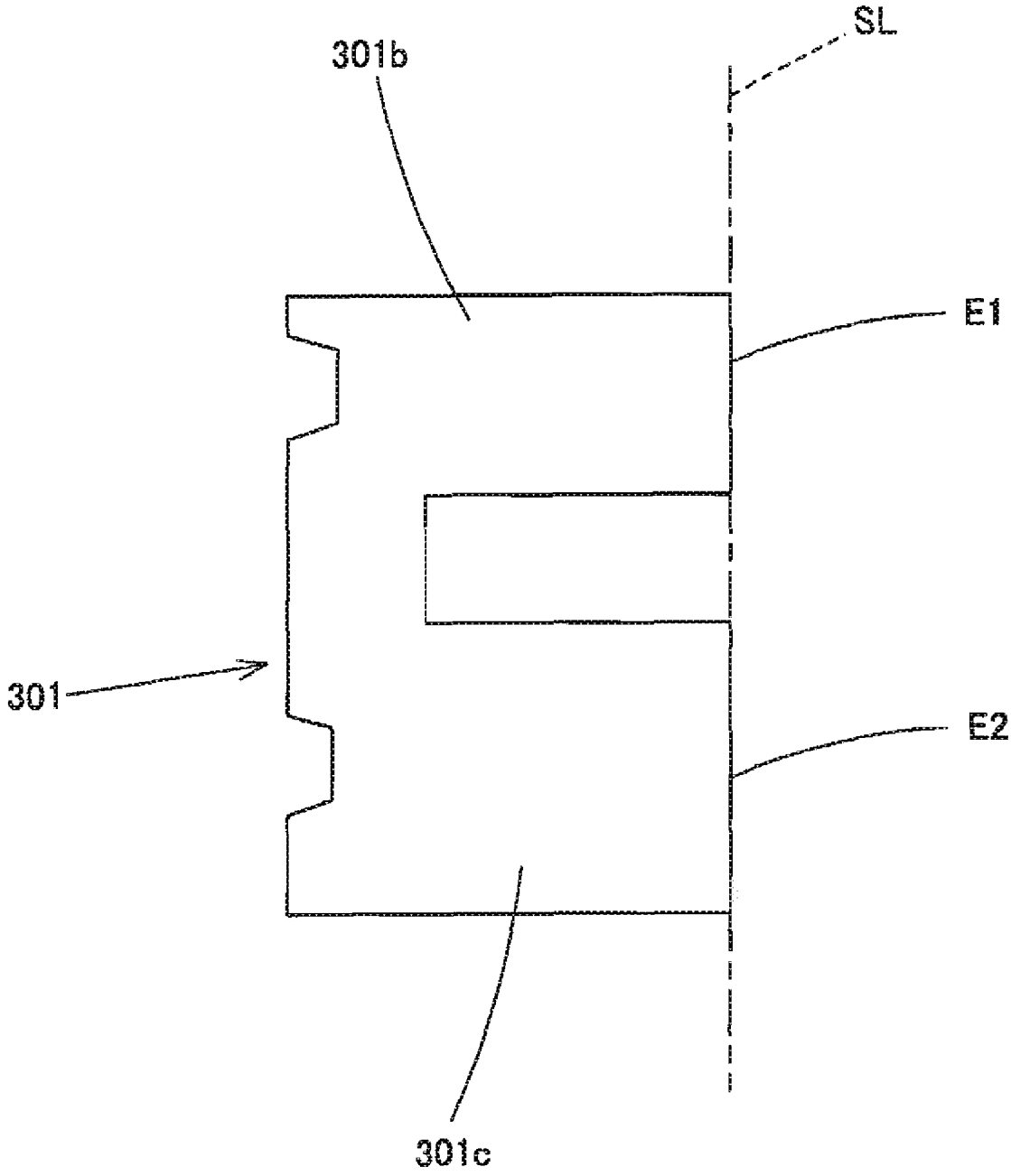
FIG. 1B is an enlarged view illustrating a vane shown in FIG. 1A.
Figure 1C:
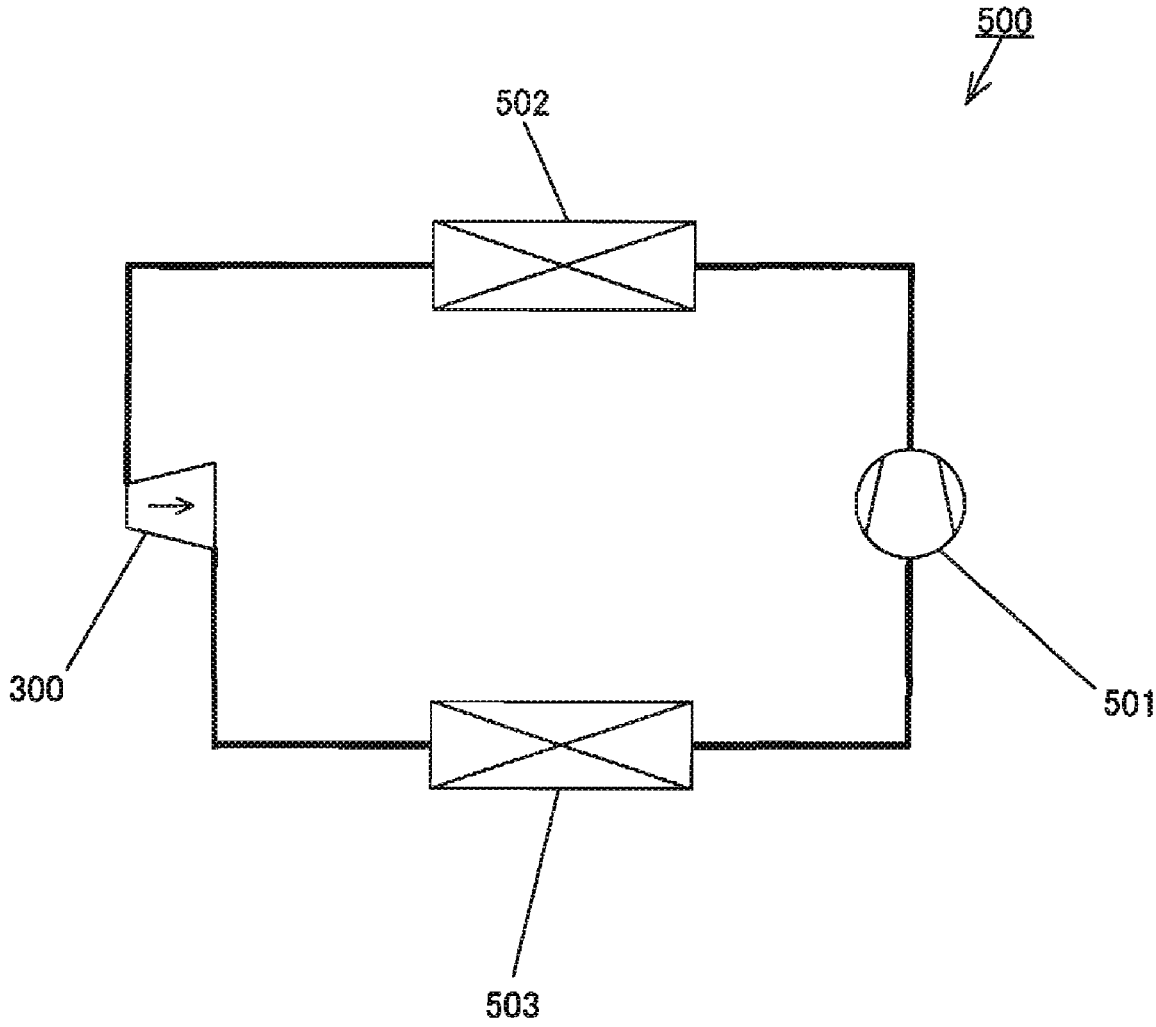
FIG. 1C is a block diagram illustrating a refrigeration cycle apparatus that can employ the expander shown in FIG. 1 suitably.

The expander 300 may be applied to a refrigeration cycle apparatus, which constitutes the substantial part of air conditioners or hot water heaters. As illustrated in FIG. 1C, a refrigeration cycle apparatus 500 includes: a compressor 501 for compressing a refrigerant; a radiator 502 for cooling the refrigerant compressed by the compressor 501; an expander 300 for expanding the refrigerant that has passed through the radiator 502; and an evaporator 503 for evaporating the refrigerant expanded by the expander 300. The expander 300 recovers the energy of expansion of the refrigerant in the form of electric power. The recovered electric power is used as a portion of the electric power necessary for driving the compressor 501. It is also possible to employ the configuration in which the energy of expansion of the refrigerant is transferred directly to the compressor 501 in the form of mechanical force without converting it into electric power, by coupling the shaft of the expander 300 and the shaft of the compressor 501 to each other.

As illustrated in FIG. 1A, in the expander 300 of the present embodiment 1, the direction of eccentricity and the amount of eccentricity of the first piston 209 and those of the second piston 210 with respect to the shaft 203 are made equal to each other. The direction of eccentricity of each of the pistons 209, 210 is the direction from the axis of the shaft 203 toward the center of each of the pistons 209, 210. The amount of eccentricity of each of the pistons 209, 210 is equal to the distance between the center of the shaft 203 and the center of each of the pistons 209, 210. A vane 301, in which a first vane portion 301*b* for the first cylinder 205 and a second vane portion 301*c* for the second cylinder 206 are formed integrally with each other, is disposed reciprocably (slidably) in the vane groove 205*a* of the first cylinder 205 and the vane groove 206*a* of the second cylinder 206. A cut-out 301*a* having a width substantially equal to the thickness of an intermediate plate 304 is provided in the vane 301, which is divided by the cut-out 301*a* into the first vane portion 301*b* whose leading end makes contact with the first piston 209 and the second vane portion 301*c* whose leading end makes contact with the second piston 210. Respective springs 213, 214 are disposed at the back sides of the first vane 301*b* and the second vane 301*c*.

In the intermediate plate 304, a cut-out 304*k* is formed at the position corresponding to the vane 301. The cut-out 304*k* is formed to have such a radial length that the intermediate plate 304 and the vane 301 do not interfere with each other when the leading end of the vane 301 is brought closest to the axis of the shaft 203. Because of the cut-out 304*k* in the intermediate plate 304, the back surface of the vane 301 is exposed to a high-pressure atmosphere outside the cylinders 205, 206, more specifically, the lubricating oil reserved in the closed casing 202. As a result, the pressure of the lubricating oil, in other words, the pressure of the working fluid that fills the interior of the closed casing 202, acts on the back surface of the vane 301.

According to such a configuration, the force resulting from the pressure difference between the interior and the exterior of the second cylinder 206 acts on the second vane portion 301*c*, which is a portion of the vane 301, in addition to the force of the spring 214, when the pistons 209, 210 move from the top dead center to the bottom dead center as the shaft 203 rotates. As a result, the second vane portion 301*c* is pushed toward the second piston 210 side. When the second vane portion 301*c* is pushed, the first vane portion 301*b*, on which the force resulting from the pressure difference does not act, also is pushed toward the first piston 209 side together with the second vane portion 301*c*. Thus, firm contact between the leading end of the first vane portion 301*b* and the first piston 209 can be ensured. Accordingly, it becomes possible to prevent instable rotation of the shaft 203 and the failure to form the working chambers 215*a*, 215*b* of the expander due to the separation of the first vane portion 301*b* from the first piston 209, as well as the performance deterioration due to leakage of the working fluid. Thus, it becomes possible to provide a highly efficient expander capable of stable operations.

Figure 22:
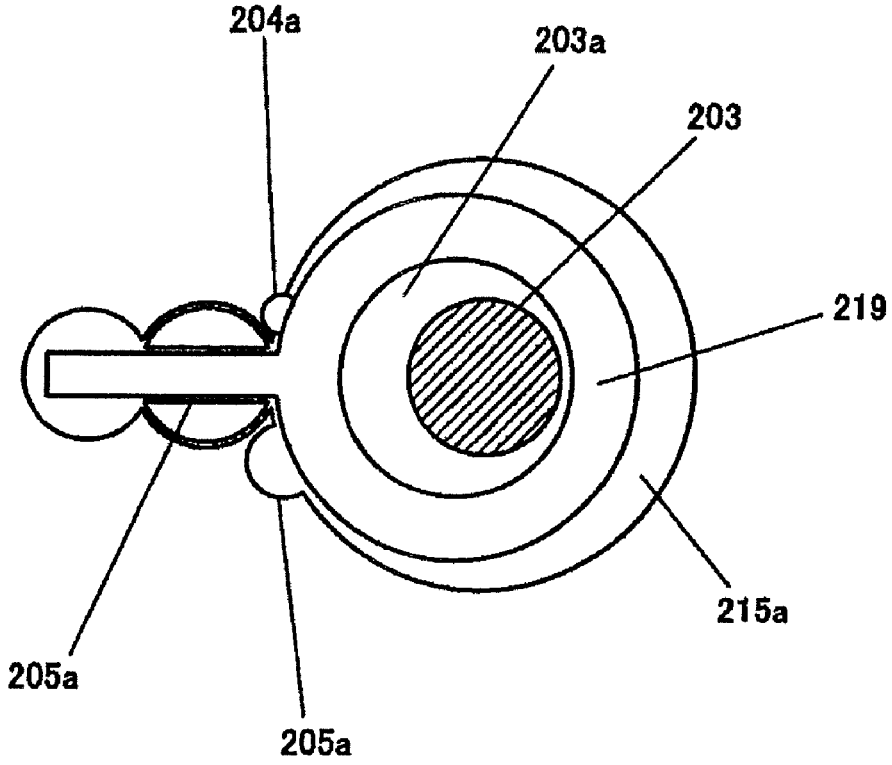
FIG.22 PRIOR ART
FIG. 22 is an enlarged horizontal cross-sectional view illustrating the expansion mechanism of a conventional expander.

Moreover, it is merely necessary to provide the cut-out 301*a* in the vane 301, so it can be processed easily. Thus, the vane 301 can be fabricated at a lower cost than the swing piston 219 shown in FIG. 22. Furthermore, the part that conventionally has required two components is made of a single component. Therefore, cost reduction due to the parts count reduction is also expected.

In the example shown in FIG. 1A, the U-shaped vane 301 is made of a single component that is inseparable, and the first vane portion 301*b* and the second vane portion 301*c* constitute one end and the other end, respectively, of the U-shaped vane 301. In other words, the relative positional relationship between the first vane portion 301*b* and the second vane portion 301*c* is invariable. In this way, by using the vane 301 having the first vane portion 301*b* and the second vane portion 301*c*, the two vane portions 301*b*, 301*c* can be synchronized easily and completely.

It should be noted that when the first piston 209 and the second piston 210 have different outer diameters, the first vane portion 301*b* and the second vane portion 301*c* need to be processed in varied lengths so that their respective leading ends make contact with the outer circumferential surfaces of the respective pistons 209, 210. On the other hand, as illustrated in FIG. 1A, when the inner diameter of the first cylinder 205 and that of the second cylinder 206 are equal to each other as well as the outer diameter of the first piston 209 and that of the second piston 210 are equal to each other, it is necessary to align the leading end of the first vane portion 301*b* and the leading end of the second vane portion 301*c* straight. More specifically, as illustrated in FIG. 1B, the leading end E1 of the first vane portion 301*b* and the leading end E2 of the second vane portion 301*c* are contained in a virtual straight line SL that is parallel to the axis of the shaft 203. In other words, the distance from the leading end E1 of the first vane portion 301*b* to the axis of the shaft 203 is equal to the distance from the leading end E2 of the second vane portion 301*c* to the axis of the shaft 203 at all times. In the vane 301, which is a single component, both the leading ends of the first vane portion 301*b* and the second vane portion 301*c* can be formed at the same time merely by processing the leading end side in advance of providing the cut-out 301*a* and later forming the cut-out 301*a*. Thus, the processing is easy, and cost reduction is possible.

In the present embodiment 1, the spring 213 is disposed at the back side of the first vane portion 301*b* and the spring 214 is disposed at the back side of the second vane portion 301*c*. However, when at least one spring is provided at the back side of the vane 301, the leading end of the first vane portion 301*b* and the leading end of the second vane portion 301*c* can be brought into firm contact with the first piston 209 and the second piston 210, respectively, upon starting the expander.

Although Embodiment 1 has described an example in which the vane made of a single component is used, the first vane and the second vane may be constituted by separate components. In this case, the relative positional relationship of the first vane and the second vane is permitted to be varied, so assembling errors and processing errors of the components tend to be compensated easily. Examples of such cases will be described in the following embodiments.

(Embodiment 2)

Figure 2:
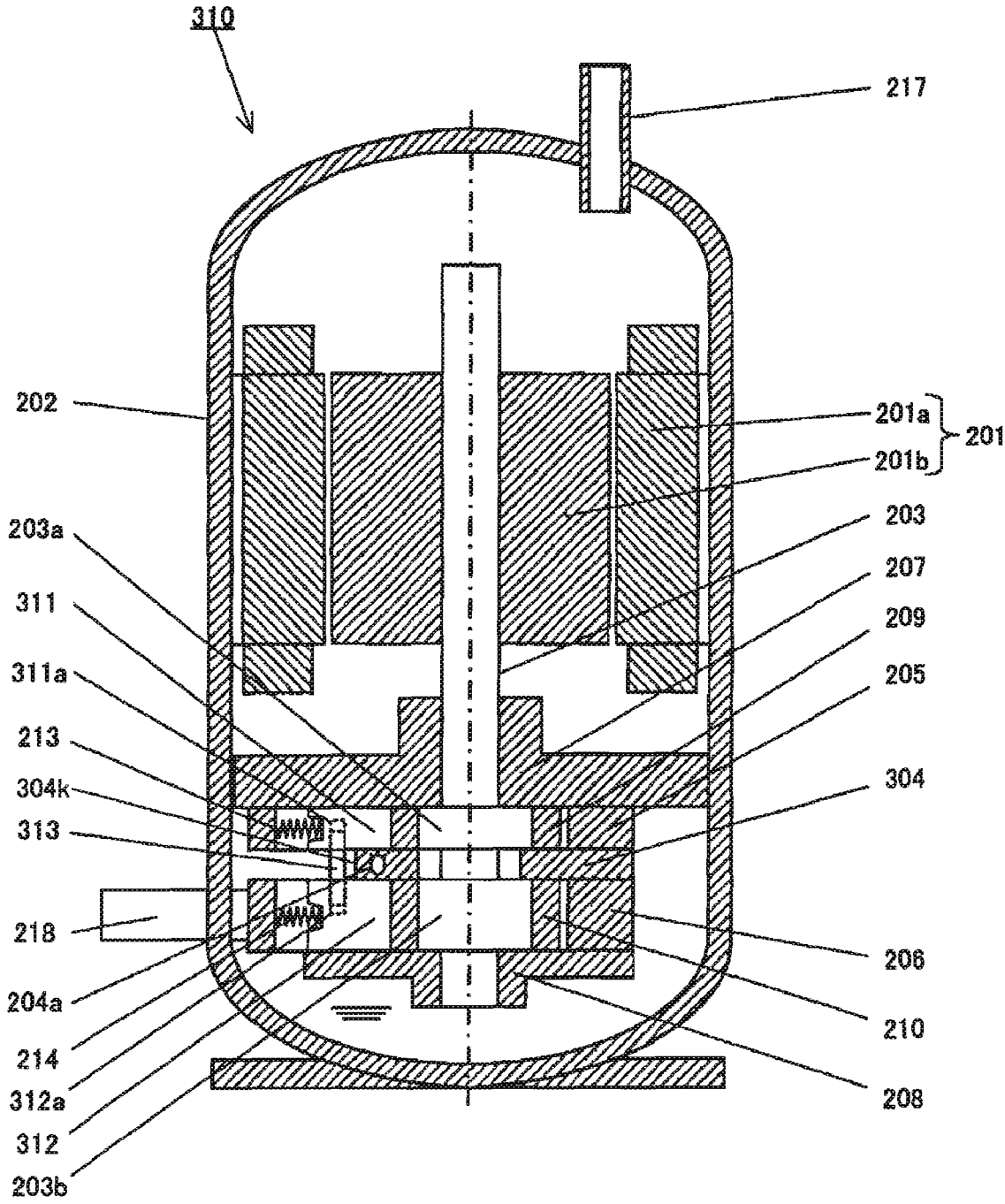
FIG. 2 is a vertical cross-sectional view illustrating an expander according to Embodiment 2 of the present invention.
Figure 3A:
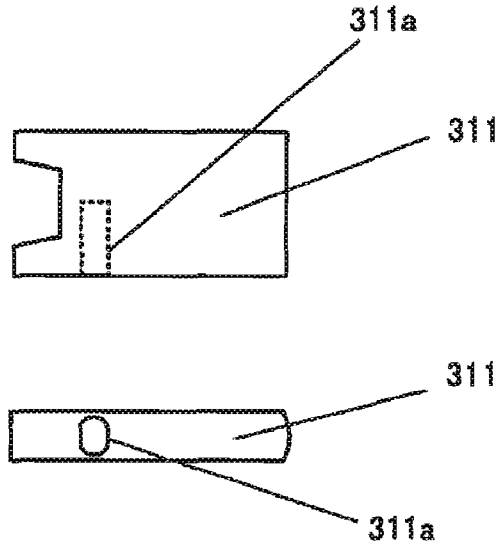
FIG. 3A shows a front view and a bottom view of a first vane of the expander shown in FIG. 2.
Figure 3B:
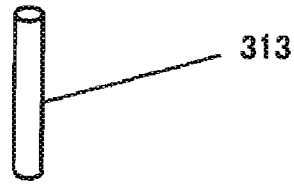
FIG. 3B is a perspective view illustrating a coupling member of the expander shown in FIG. 2.
Figure 3C:
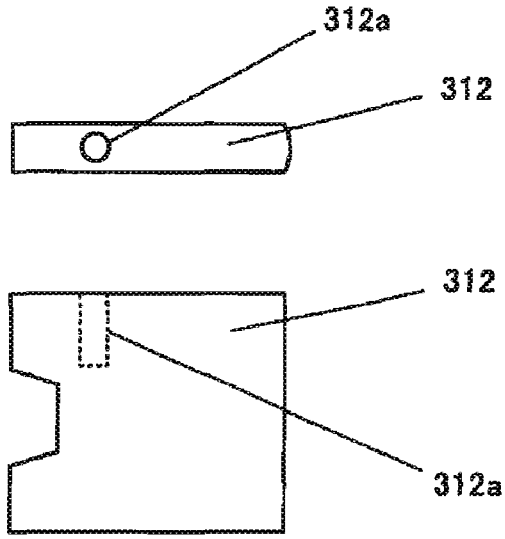
FIG. 3C shows a plan view and a front view of a second vane of the expander shown in FIG. 2.

FIG. 2 is a vertical cross-sectional view illustrating the configuration of an expander 310 according to Embodiment 2 of the present invention. FIG. 3A shows a front view and a bottom view of the first vane shown in FIG. 2. FIG. 3B is a perspective view illustrating the coupling member shown in FIG. 2. FIG. 3C shows a plan view and a front view of the second vane shown in FIG. 2. The configuration of the expander 310 of the present embodiment 2 is the same as that of the conventional rotary type expander 200 that has been illustrated with reference to FIGS. 17, 18, and 21, except for the vanes and the intermediate plate. The same functional components are designated by the same reference numerals, and the descriptions of the same configurations and workings as those of the conventional examples will be omitted.

The expander 310 of the present embodiment 2 has a transferring member for transferring a force acting on a second vane 312 to a first vane 311 to link a movement of the first vane 311 to a movement of the second vane 312. The use of such a transferring member enables the second vane 312 to press the first vane 311 reliably. More specifically, a coupling member 313 for coupling the first vane 311 and the second vane 312 to each other is employed as the transferring member.

In the expander 310 of the present embodiment 2, the direction of eccentricity and the amount of eccentricity of the first piston 209 and those of the second piston 210 with respect to the shaft 203 are made equal to each other. The first vane 311 and the second vane 312 are disposed in the vane groove 205*a* of the first cylinder 205 and the vane groove 206*a* of the second cylinder 206, respectively, so that they can slide back and forth. In the lower face of the first vane 311, an elliptical hole 311*a* extending perpendicular to the lower face is formed, while in the upper face of the second vane 312, a cylindrical hole 312*a* extending perpendicular to the upper face is formed. One end of the columnar coupling member 313 is inserted in the cylindrical hole 312*a* rotatably, and slidably in a depth direction of the cylindrical hole 312*a*, with a very small clearance. The other end of the coupling member 313 is inserted in the elliptical hole 311*a* with a smaller clearance along the minor axis, rotatably and slidably both in a depth direction of the elliptical hole 311*a* and in the major axis of the elliptical hole 311*a*. Respective springs 213, 214 are disposed at the back sides of the first vane 311 and the second vane 312.

According to such a configuration, when the pistons 209, 210 move from the top dead center to the bottom dead center as the shaft 203 rotates, the second vane 312 is pushed toward the second piston 210 side due to the force resulting from the pressure difference between the interior and the exterior of the second cylinder 206 in addition to the force of the spring 214, and the leading end thereof is brought into contact with the second piston 210. At this time, the first vane 311, on which the force resulting from the pressure difference does not act, is also pushed together with the second vane 312 toward the first piston 209 side by the coupling member 313. Thus, firm contact between the leading end of the first vane 311 and the first piston 209 can be ensured. Accordingly, it becomes possible to prevent instable rotation of the shaft 203 and the failure to form the working chambers 215*a*, 215*b* of the expander due to the separation of the first vane 311 from the first piston 209, as well as the performance deterioration due to leakage of the working fluid. Thus, it becomes possible to provide a highly efficient expander capable of stable operations.

In the case of Embodiment 1, the relationship between the width of the cut-out 301*a* of the vane 301 and the thickness of the intermediate plate 304 in FIG. 1A should be as follows; the width of the cut-out 301*a* needs to be slightly larger than the thickness of the intermediate plate 304 within a range such that the vane 301 is reciprocable and at the same time the leakage from the clearance is sufficiently small and permissible (from about 10 μm to about 20 μm). Therefore, processing accuracy for the intermediate plate 304 and the cut-out 301*a* as well as matching between the intermediate plate 304 and the cut-out 301*a* is required. The vane width from the upper face of the first vane portion 301*b* to the lower face of the second vane 301*c* should be made smaller than the total of the thicknesses of the first cylinder 205, the second cylinder 206, and the intermediate plate 304 within such a range that the leakage from the clearance is sufficiently small and permissible (from about 10 μm to about 20 μm). In contrast, in the present embodiment 2, the coupling member 313 is slidable in an axis direction in the elliptical hole 311*a* and the cylindrical hole 312*a*, and therefore, the width between the lower face of the first vane 311 and the upper face of the second vane 312 is variable even when there are some variations in the thickness of the intermediate plate 304. Thus, processing and assembling as well as setting of the clearance can be performed easily.

In addition, in the present embodiment 2, the elliptical hole 311*a* is formed in the first vane 311, and the coupling member 313 is slidable (swingable) in the major axis direction of the elliptical hole 311*a*. The major axis direction of the elliptical hole 311*a* is along the direction of rotation of the shaft 203. Since the coupling member 313 is adjusted to be shorter than the distance (minimum distance) between the bottom face of the elliptical hole 311*a* of the first vane 311 and the bottom face of the cylindrical hole 312*a* of the second vane 312, it can move also in depth directions of the cylindrical hole 312*a* and the elliptical hole 311*a*. That is, the coupling member 313 can slightly move in a direction perpendicular to a direction of the reciprocating motion of the first vane 311 and the second vane 312. In other words, the coupling member 313 transfers the force acting on the second vane 312 to the first vane 311 while compensating the change in the relative positional relationship between the first vane 311 and the second vane 312. For this reason, even in such a case that the vane groove 205*a* of the first cylinder 205 and the vane groove 206*a* of the second cylinder 206 are misplaced microscopically along the direction of rotation or they are not completely parallel to each other because of assembling errors, the first vane 311 and the second vane 312 are prevented from being twisted in the respective vane grooves 205*a*, 206*a* and are driven smoothly. As a result, damages to the vanes 311, 312 and abnormal wearing in the sliding surfaces are prevented, and thus, a highly reliable expander can be provided.

It should be noted that although the coupling member 313 in a columnar shape is used in the present embodiment 2, the same advantageous effects are obtained also when using coupling members with other shapes, such as cuboid shapes and elliptic cylinder shapes. In addition, the coupling member 313 need not be made of a metal, as in the case of the vanes 311, 312 and may be made of other hard materials such as ceramics and engineering plastics. Alternatively, the entire coupling member 313 may be constituted by an elastic body such as elastomer.

Figure 3D:
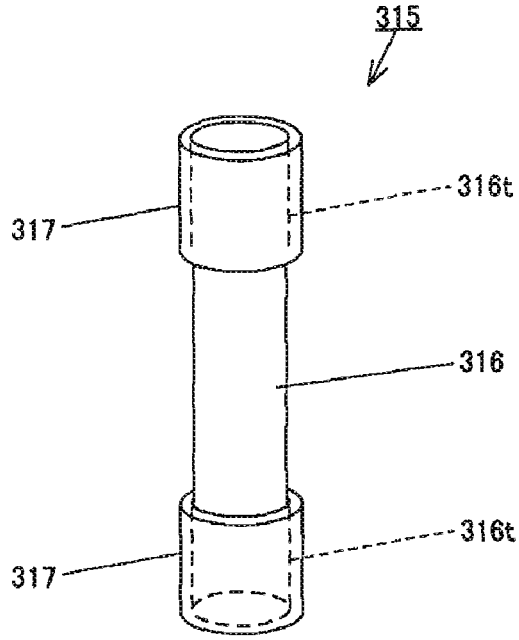
FIG. 3D is a perspective view illustrating another example of the coupling member.

Furthermore, it is also possible to use a coupling member having a portion made of an elastic body. For example, as illustrated in FIG. 3D, it is possible to use a coupling member 315 having a rod-shaped main body portion 316 and tubular bodies 317, 317 made of rubber in which end portions 316*t*, 316*t* of the rod-shaped main body portion 316 are inserted, in place of the coupling member 313 shown in FIG. 3B. The main body portion 316 may be constituted of a hard material such as metal, ceramic, and engineering plastic. The tubular body 317 may be constituted by an elastomer, such as isoprene rubber, styrene rubber, nitrile rubber, butadiene rubber, chloroprene rubber, and urethane rubber. The tubular body 317 may be attached to only one of the end portions 316*t*, although it is desirable that the tubular body 317 be attached to both of the end portions 316*t*, 316*t* of the main body portion 316. With such a coupling member 315, various errors may be compensated by elastic deformation of the tubular body 317 even when a clearance is not particularly provided between it and the holes of the vanes 311, 312.

Figure 3E:
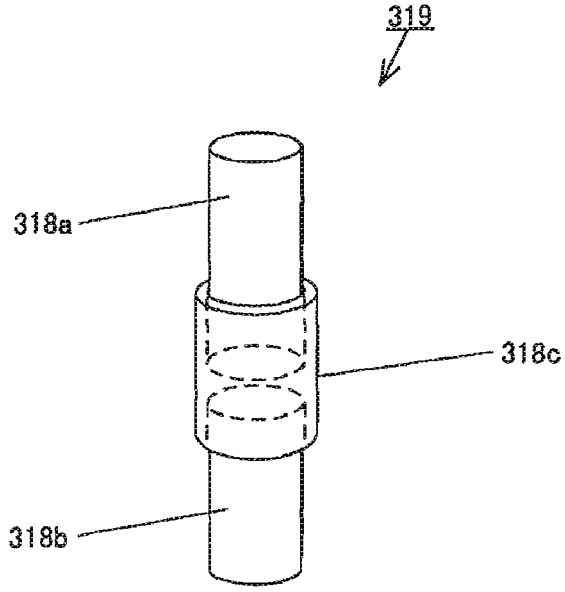
FIG. 3E is a perspective view illustrating yet another example of the coupling member.

In addition, as illustrated in FIG. 3E, it is possible to suitably use a coupling member 319 having a rod-shaped first main body portion 318*a* to be fitted in the hole 311*a* of the first vane 311, a rod-shaped second main body portion 318*b* to be fitted in the hole 312*a* of the second vane 312, and a tubular body 318*c* made of rubber, for connecting the first main body portion 318*a* and the second main body portion 318*b* to each other. With this coupling member 319, the amount of expansion and contraction of the tubular body 318*c* can be set relatively large because the tubular body 318*c* is disposed between the first cylinder 205 and the second cylinder 206 with respect to the direction parallel to the axis of the shaft 203.

(Embodiment 3)

Figure 4:
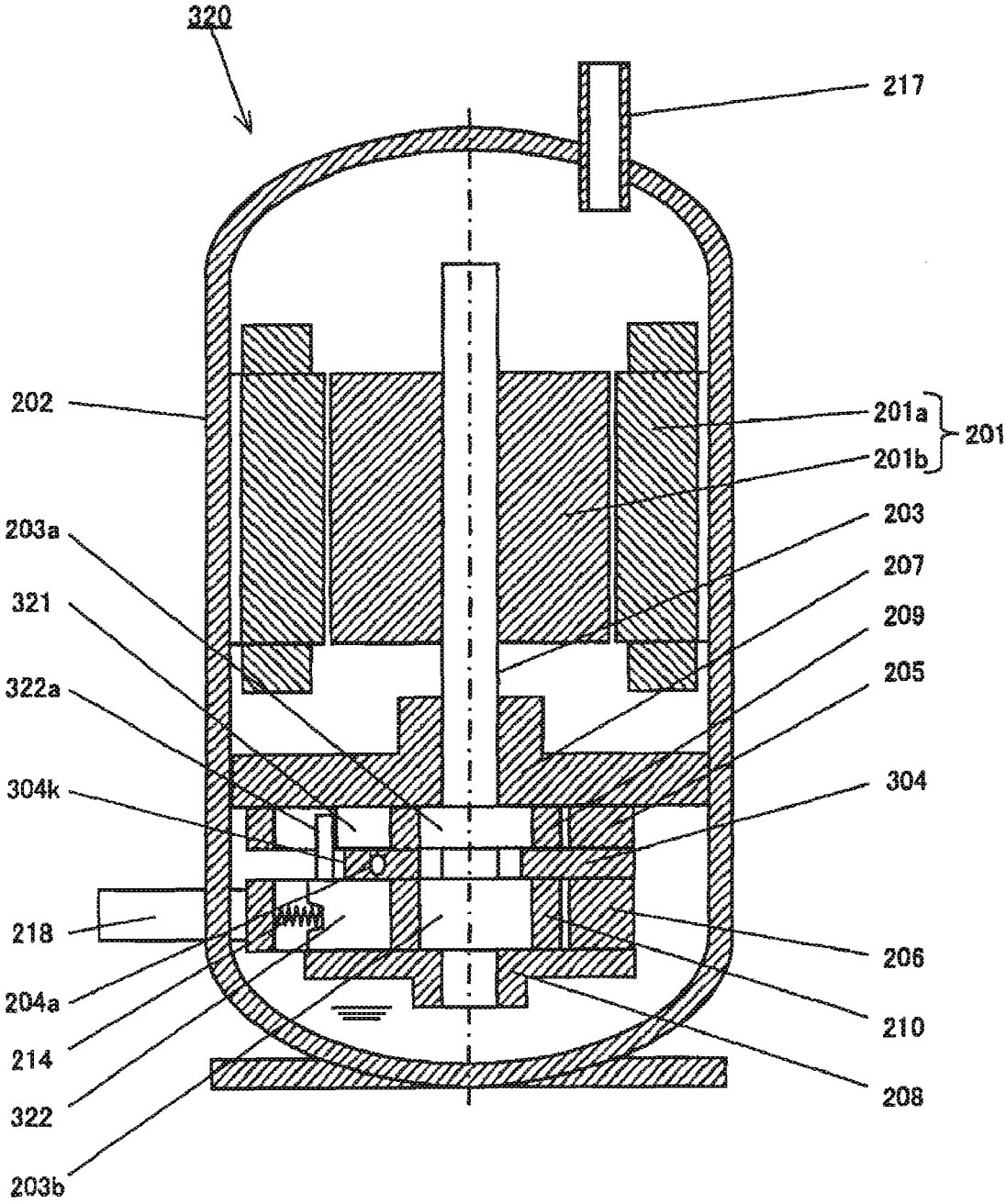
FIG. 4 is a vertical cross-sectional view illustrating an expander according to Embodiment 3 of the present invention.
Figure 5:
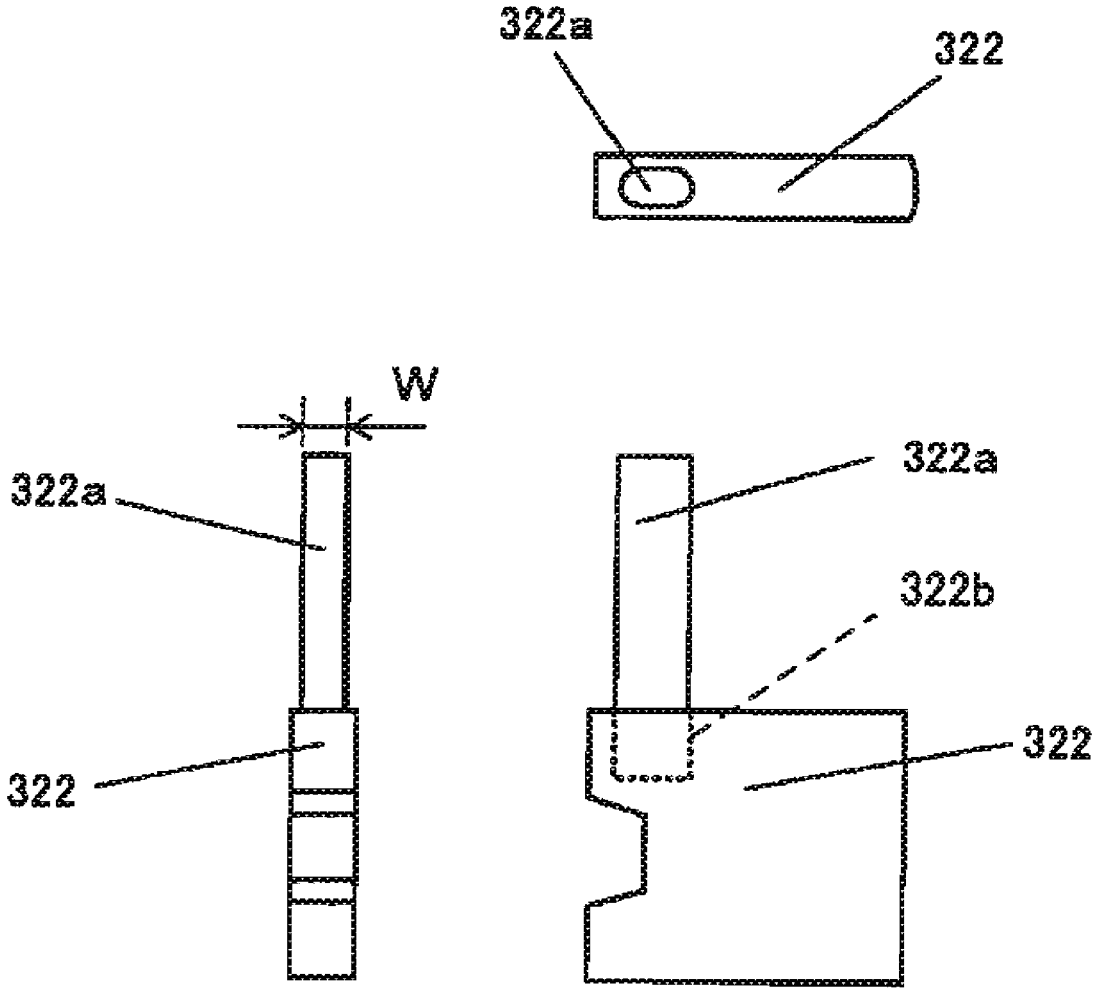
FIG. 5 is an enlarged view illustrating a vane of the expander shown in FIG. 4.

FIG. 4 is a vertical cross-sectional view illustrating the configuration of an expander 320 according to Embodiment 3 of the present invention. FIG. 5 shows a front view, a side view, and a plan view of the second vane of the expander shown in FIG. 4. The configuration of the expander 320 of the present embodiment 3 is the same as that of the conventional rotary type expander 200 that has been illustrated with reference to FIGS. 17, 18, and 21, except for the vanes and the intermediate plate. The same functional components are designated by the same reference numerals, and the descriptions of the same configurations and workings as those of the conventional examples will be omitted.

In the expander 320 of the present embodiment 3, the direction of eccentricity and the amount of eccentricity of the first piston 209 and those of the second piston 210 with respect to the shaft 203 are made equal to each other. A first vane 321 and a second vane 322 are disposed reciprocably in the vane groove 205*a* of the first cylinder 205 and the vane groove 206*a* of the second cylinder 206, respectively. A protruding portion 322*a* is provided on the first vane side of the second vane 322. The protruding portion 322*a* is in contact with back surface of the first vane 321. As illustrated in FIG. 5, the protruding portion 322*a* is fitted in a hole 322*b* formed in the second vane 322 and is joined to the second vane 322. The thickness W of the protruding portion 322*a* is made thinner than the thickness of the first vane 321. The thickness of the protruding portion 322*a* as well as the thickness of the first vane 321 refers to a thickness along a direction perpendicular to both the sliding direction of the vanes 321, 322 and the axis of the shaft 203. The spring 214 is disposed at the back side of the second vane 322.

According to such a configuration, when the pistons 209, 210 move from the top dead center to the bottom dead center as the shaft 203 rotates, the second vane 322 is pushed toward the second piston 210 side due to the force resulting from the pressure difference between the interior and the exterior of the second cylinder 206, and the leading end thereof is brought into contact with the second piston 210. At this time, the first vane 321, on which the force resulting from the pressure difference does not act, is also pushed toward the first piston 209 side by the protruding portion 322*a*, together with the second vane 322. Thus, firm contact between the leading end of the first vane 321 and the first piston 209 can be ensured. Accordingly, it becomes possible to prevent instable rotation of the shaft 203 and the failure to form the working chambers 215*a*, 215*b* of the expander due to the separation of the first vane 321 from the first piston 209, as well as the performance deterioration due to leakage of the working fluid. Thus, it becomes possible to provide a highly efficient expander capable of stable operations.

Moreover, since the first vane 321 and the second vane 322 are separate components, processing and assembling of the vanes 321, 322 as well as setting of the clearance can be performed easily independent of the thickness of the intermediate plate, unlike Embodiment 1.

Furthermore, since the protruding portion 322*a*, which is a separate component from the second vane 322, is fitted in the hole 322*b* formed in the second vane 322 and joined thereto, it is possible to provide the protruding portion 322*a* after polishing the upper face of the second vane 322. Therefore, the second vane 322 can be processed with high precision, and the processing becomes easy. It should be noted, however, that there is no difference in function when the second vane 322 and the protruding portion 322*a* are formed integrally with each other at the outset.

In addition, in the present embodiment 3, the thickness W of the protruding portion 322*a* is made thinner than the thickness of the first vane 321. For this reason, even when the vane groove 205*a* of the first cylinder 205 and the vane groove 206*a* of the second cylinder 206 are misplaced microscopically along the direction of rotation or they are not completely parallel to each other because of assembling errors, such errors can be compensated by the difference between the thickness of the protruding portion 322*a* and the thickness of the first vane 321. As a result, the protruding portion 322*a* is prevented from being twisted in the vane groove 205*a*, the vanes 321, 322 can be driven smoothly. Therefore, damages to the vanes 321, 322 and abnormal wearing in the sliding surfaces are prevented, and thus, a highly reliable expander can be provided.

Figure 6:
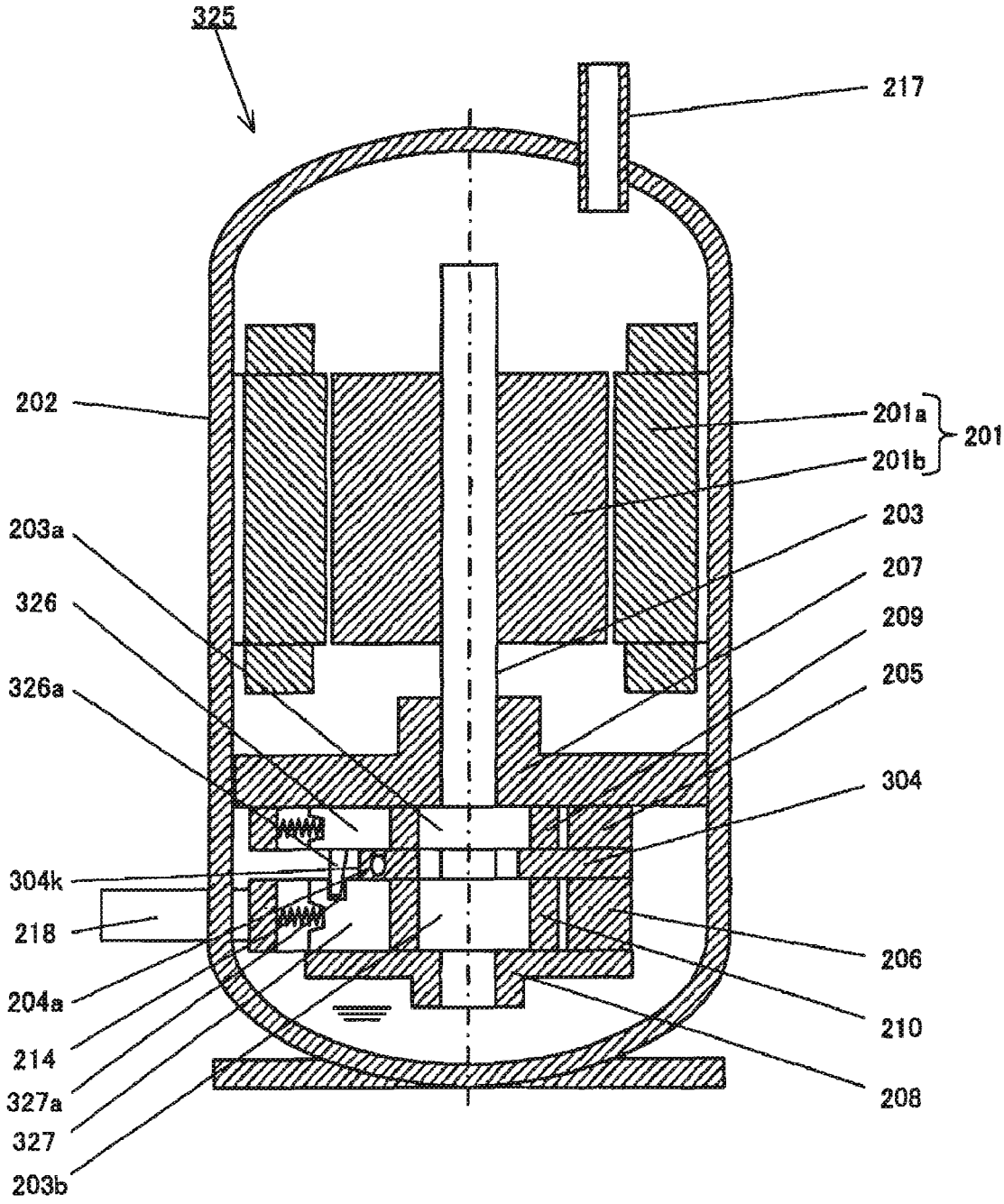
FIG. 6 is a vertical cross-sectional view illustrating another expander according to Embodiment 3 of the present invention.

It should be noted that although the protruding portion 322*a* is provided in the second vane 322 in the present embodiment 3, it is also possible to employ a configuration as an expander 325 shown in FIG. 6 in which a protruding portion 326*a* is formed on the lower face of a first vane 326 so that it is caught by a cut-out 327*a* formed in a second vane 327. In this way, the same advantageous effects also can be obtained because the second vane 327 firmly presses the first vane 326 toward the first piston 209 by the protruding portion 326*a*.

(Embodiment 4)

Figure 7:
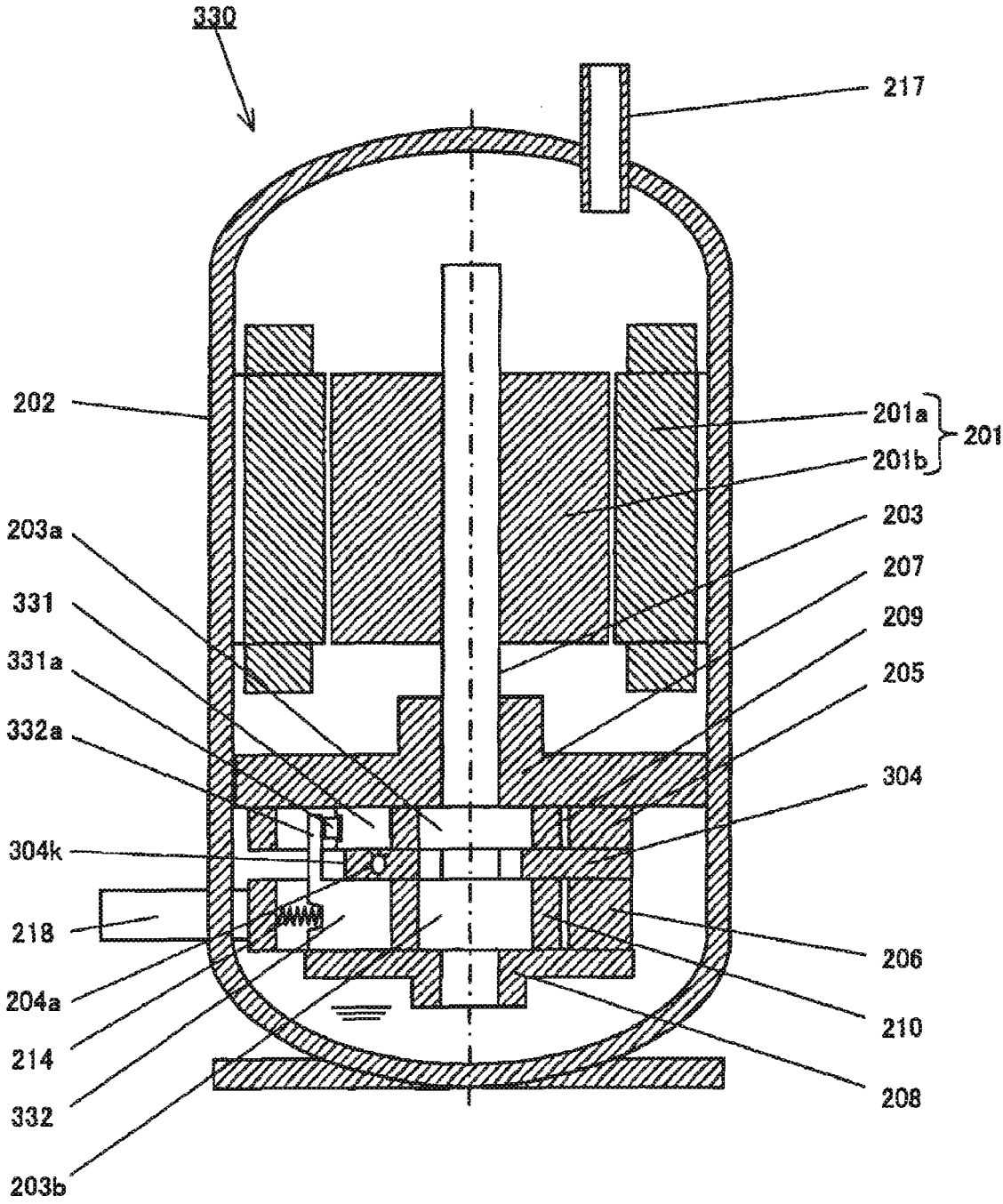
FIG. 7 is a vertical cross-sectional view illustrating an expander according to Embodiment 4 of the present invention.

FIG. 7 is a vertical cross-sectional view illustrating an expander 330 according to Embodiment 4 of the present invention. The configuration of the expander 330 of the present embodiment 4 is the same as that of the conventional rotary type expander 200 that has been illustrated with reference to FIGS. 17, 18, and 21, except for the vanes and the intermediate plate. The same functional components are designated by the same reference numerals, and the descriptions of the same configurations and workings as those of the conventional examples will be omitted.

In the expander 330 of the present embodiment 4, the direction of eccentricity and the amount of eccentricity of the first piston 209 and those of the second piston 210 with respect to the shaft 203 are made equal to each other. A first vane 331 and a second vane 332 are disposed reciprocably in the vane groove 205*a* of the first cylinder 205 and the vane groove 206*a* of the second cylinder 206, respectively. An elastic portion 331*a* made of resin is disposed at the back side of the first vane 331. The elastic portion 331*a* may be constituted by an elastomer, such as isoprene rubber, styrene rubber, nitrile rubber, butadiene rubber, chloroprene rubber, and urethane rubber. Also, a protruding portion 332*a* is provided on the first vane side of the second vane 332, and the protruding portion 332*a* is in contact with the elastic portion 331*a* at the back side of the first vane 331.

According to such a configuration, when the pistons 209, 210 move from the top dead center to the bottom dead center as the shaft 203 rotates, the second vane 332 is pushed toward the second piston 210 side due to the force resulting from the pressure difference between the interior and the exterior of the second cylinder 206, and the leading end thereof is brought into contact with the second piston 210. At this time, the first vane 331, on which the force resulting from the pressure difference does not act, is also pushed together with the second vane 332 toward the first piston 209 side by the protruding portion 332*a* and the elastic portion 331*a*. Thus, firm contact between the leading end of the first vane 331 and the first piston 209 can be ensured. Accordingly, it becomes possible to prevent instable rotation of the shaft 203 and the failure to form the working chambers 215*a*, 215*b* of the expander due to the separation of the first vane 331 from the first piston 209, as well as the performance deterioration due to leakage of the working fluid. Thus, it becomes possible to provide a highly efficient expander capable of stable operations.

Moreover, even when the first vane 331 becomes shorter because of processing errors, so a clearance forms between the protruding portion 332*a* of the second vane 332 and the back surface of the first vane 331 and collision occurs every time the protruding portion 332*a* of the second vane 332 presses the first vane 331, the sound of the collision is prevented and also the breakage of the vanes 331, 322 due to the collision is prevented by providing the elastic portion 331*a* at the back side of the first vane 331. Thus, a low-noise and highly reliable expander can be provided.

Conversely, when the first vane 331 becomes longer due to processing errors, it is believed that a clearance may form between the leading end side of the second vane 332 and the second piston 210. However, in the present embodiment 4, the elastic portion 331*a* of the first vane 331 deforms and compensates the clearance. Therefore, no clearance forms between the leading end side of the second vane 332 and the second piston 210. Thus, leakage of the working fluid can be prevented, and as a result, a highly efficient expander can be provided.

It should be noted that although the elastic portion 331*a* is provided on the first vane 331 in the present embodiment 4, the same advantageous effects can be obtained when an elastic portion is provided on the protruding portion 332*a* of the second vane 332 or when the protruding portion 332*a* of the second vane 332 is constituted by an elastic body.

(Embodiment 5)

Figure 8:
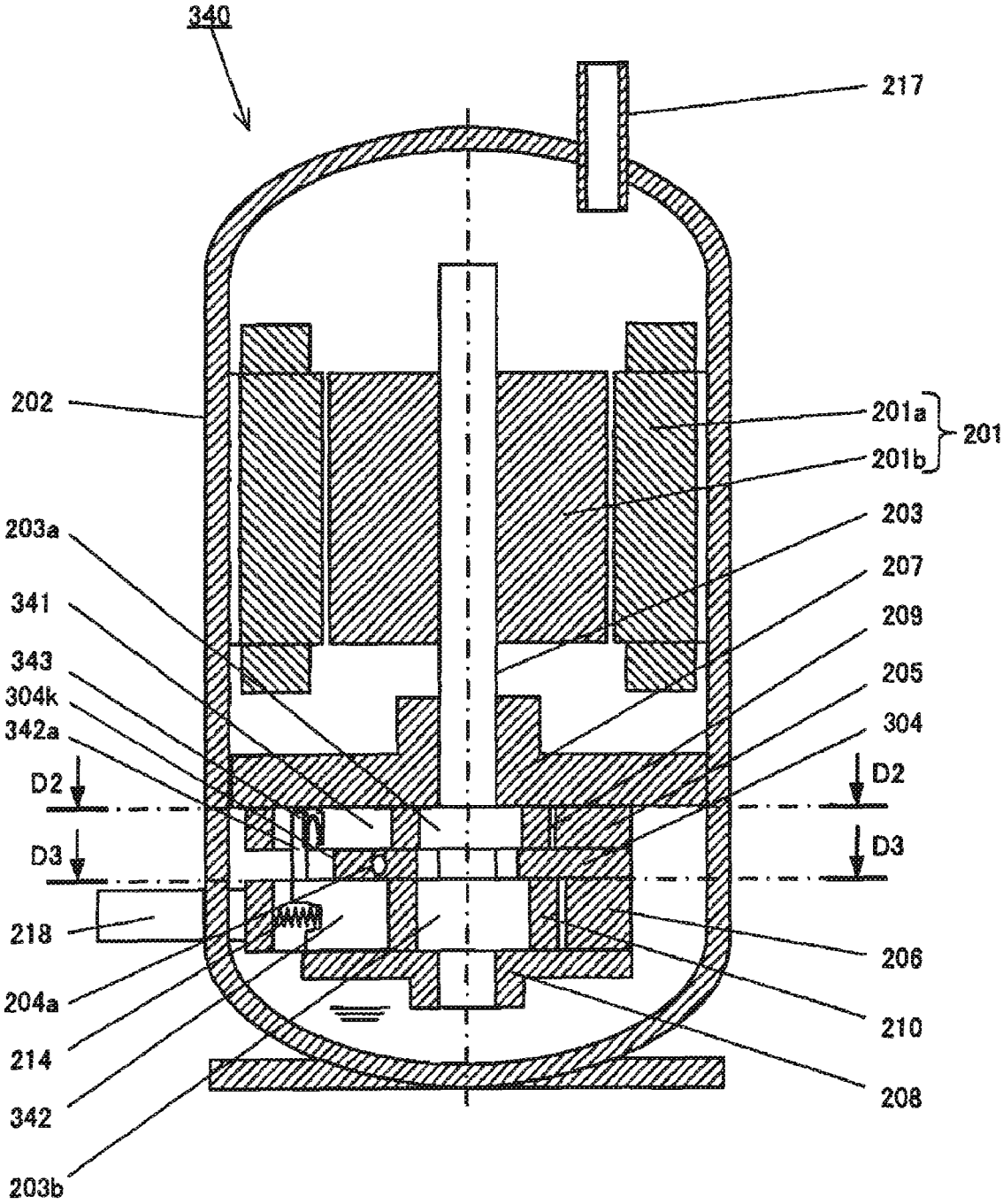
FIG. 8 is a vertical cross-sectional view illustrating an expander according to Embodiment 5 of the present invention.
Figure 9A:
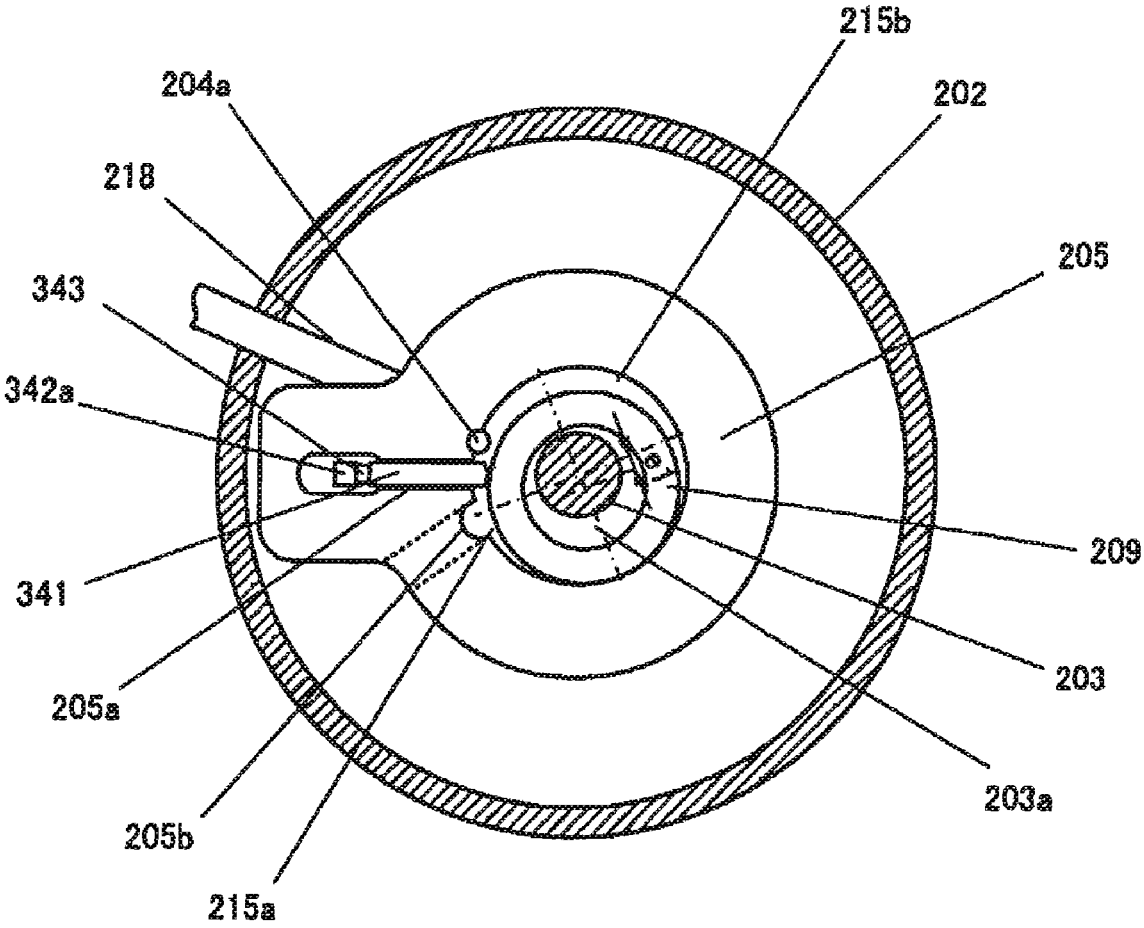
FIG. 9A is a horizontal cross-sectional view of the expander shown in FIG. 8, taken along line D2-D2.
Figure 9B:
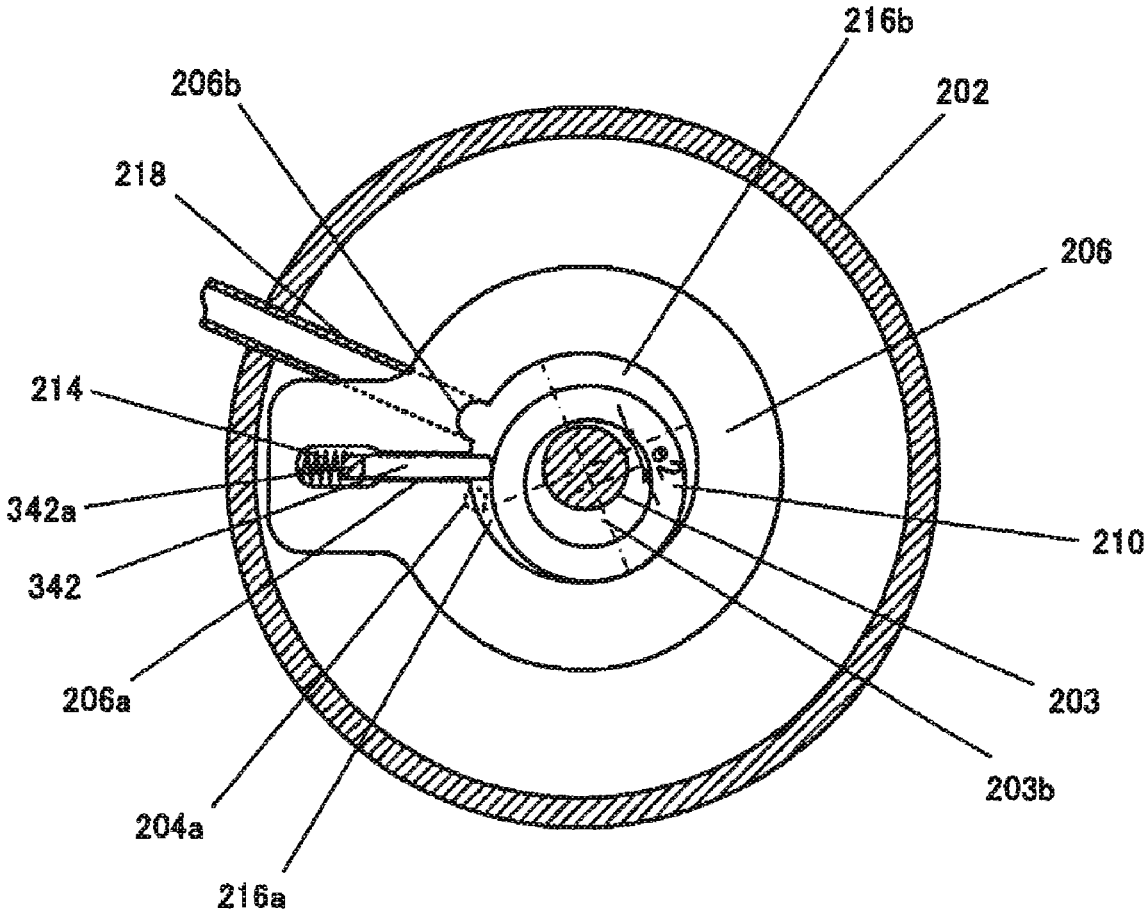
FIG. 9B is a horizontal cross-sectional view of the expander shown in FIG. 8, taken along line D3-D3.

FIG. 8 is a vertical cross-sectional view illustrating an expander 340 according to Embodiment 5 of the present invention. FIG. 9A is a horizontal cross-sectional view of the expander shown in FIG. 8, taken along line D2-D2. FIG. 9B is a horizontal cross-sectional view of the expander shown in FIG. 8, taken along line D3-D3. The configuration of the expander 340 of the present embodiment 5 is the same as that of the conventional rotary type expander 200 that has been illustrated with reference to FIGS. 17, 18, and 21, except for the vanes, the intermediate plate, and the amount of eccentricity of the pistons. The same functional components are designated by the same reference numerals, and the descriptions of the same configurations and workings as those of the conventional examples will be omitted.

In the expander 340 of the present embodiment 5, the direction of eccentricity of the first piston 209 and that of the second piston 210 are the same with respect to the shaft 203. However, the amount of eccentricity e1 of the first piston 209, shown in FIG. 9A, is made smaller than the amount of eccentricity e2 of the second piston 210 shown in FIG. 9B. A first vane 341 and a second vane 342 are disposed reciprocably in the vane groove 205*a* of the first cylinder 205 and the vane groove 206*a* of the second cylinder 206, respectively. A protruding portion 342*a* is provided on the first vane side of the second vane 342, and a spring 343 as an elastic body that expands and contracts in sliding directions of the first vane 341 is disposed between the back surface of the first vane 341 and the protruding portion 342*a* of the second vane 342. The bending amount (expansion-contraction length) of the spring 343 is set to be two times or greater the difference between the amount of eccentricity e1 of the first piston 209 and the amount of eccentricity e2 of the second piston 210. For example, assuming that the amount of eccentricity e1 of the first piston 209 is 1.5 mm and the amount of eccentricity e2 of the second piston 210 is 2.0 mm, it is sufficient that the spring should bend 1.0 mm or more. The spring constant should be set sufficiently large. Specifically, it is desirable that the spring constant be such that the maximum bending amount is reached by a force about ¼ of the force resulting from the pressure difference acting on the second vane 342. As described in the Background Art, a force of about 20 kgf acts on the second vane 342. Therefore, the spring constant in the case that the spring bends 1 mm by a force ¼ of that force is 5 kgf/mm. Since this is disposed between the back side of the first vane 341 and the protruding portion 342*a* of the second vane 342, a flat spring and a belleville spring are desirable for the spring 343, rather than a coil spring.

According to such a configuration, when the pistons 209, 210 move from the top dead center to the bottom dead center as the shaft 203 rotates, the second vane 342 is pushed toward the second piston 210 side due to the force resulting from the pressure difference between the interior and the exterior of the second cylinder 206, and the leading end thereof is brought into contact with the second piston 210. At this time, the first vane 341, on which the force resulting from the pressure difference does not act, is also pushed together with the second vane 342 toward the first piston 209 side by the protruding portion 342*a* and the spring 343. Here, the stroke of the reciprocating motion of the first vane 341 is two times the amount of eccentricity e1 of the first piston 209, and the stroke of the reciprocating motion of the second vane 342 is two times the amount of eccentricity e2 of the second piston 210. Therefore, when considering the top dead center as a reference, the distance by which the second vane 342 presses the first vane 341 and the distance by which the first vane 341 moves do not match. However, by providing the spring 343 that has a stroke two times the difference between the amount of eccentricity of the first piston 209 and that of the second piston 210, the difference between the distances can be compensated. Thus, firm contact between the leading end of the first vane 341 and the first piston 209 can be ensured even when the amount of eccentricity e1 of the first piston 209 and the amount of eccentricity e2 of the second piston 210 are different. Accordingly, it becomes possible to prevent instable rotation of the shaft 203 and the failure to form the working chambers 215*a*, 215*b* of the expander due to the separation of the first vane 341 from the first piston 209, as well as the performance deterioration due to leakage of the working fluid. Thus, it becomes possible to provide a highly efficient expander capable of stable operations.

In addition, the effect of pushing the first vane 341 can be obtained also when the spring 343 is provided between the first cylinder 205 and the first vane 341. However, by providing the spring 343 between the back surface of the first vane 341 and the protruding portion 342*a* of the second vane 342, the stroke of the spring 343 may be made small, so the above-described spring of about 5 kgf/mm may be made more compact. As a result, the spring may be disposed in the limited space at the back of the vane 341.

The reason why the spring constant of the spring 343 is set to be a force about ¼ of the force resulting from the pressure difference acting on the second vane 342 is as follows. The force resulting from the pressure difference acting on the second vane 342 reduces by about ¼ because of the reaction force of the spring 343, but the force sufficient for pushing the second vane 342 still remains. Moreover, the force for pushing the first vane 341 is sufficient when there is a force about ¼ of the force resulting from the pressure difference acting on the second vane 342.

(Embodiment 6)

Figure 10:
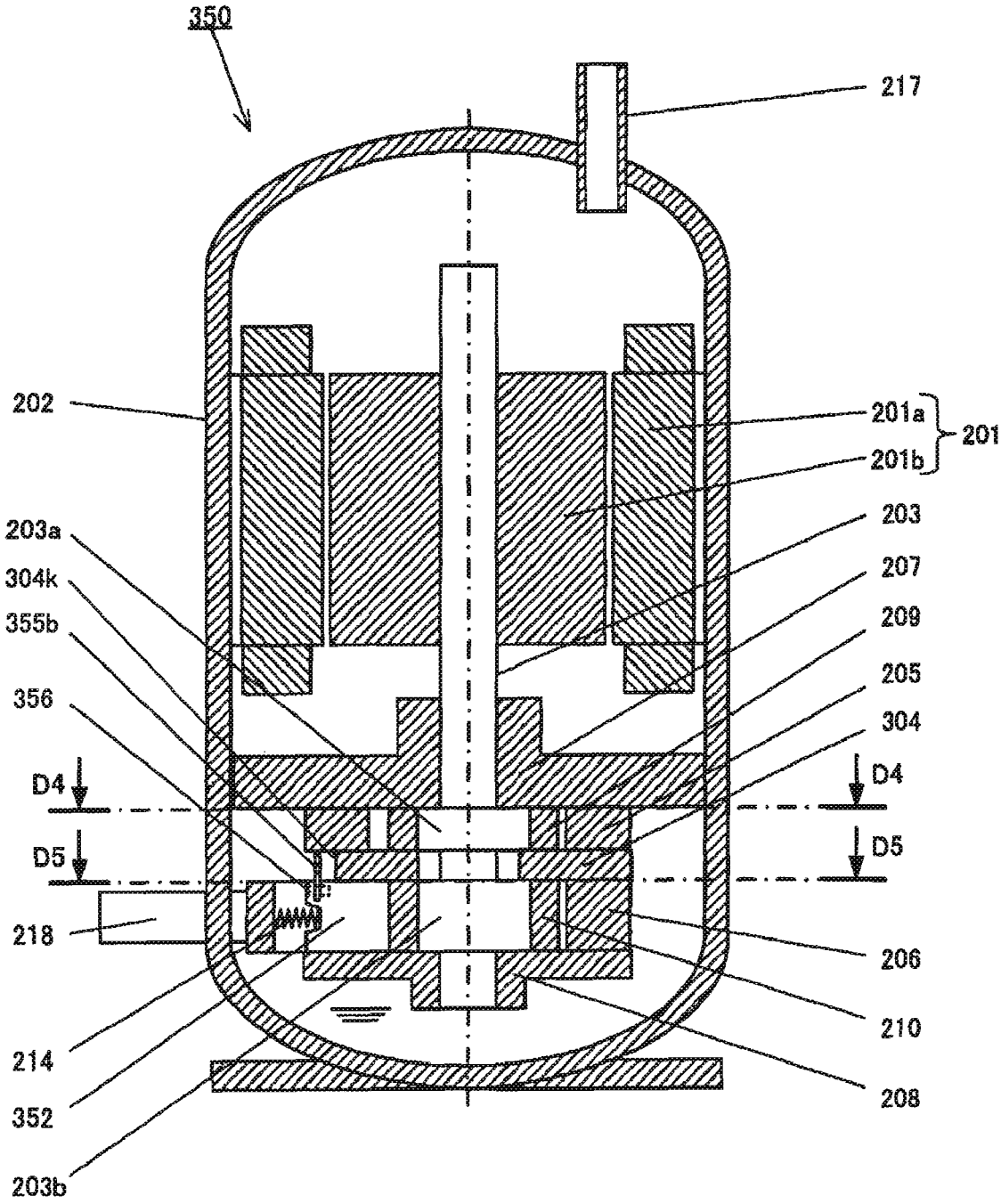
FIG. 10 is a vertical cross-sectional view illustrating an expander according to Embodiment 6 of the present invention.
Figure 11A:
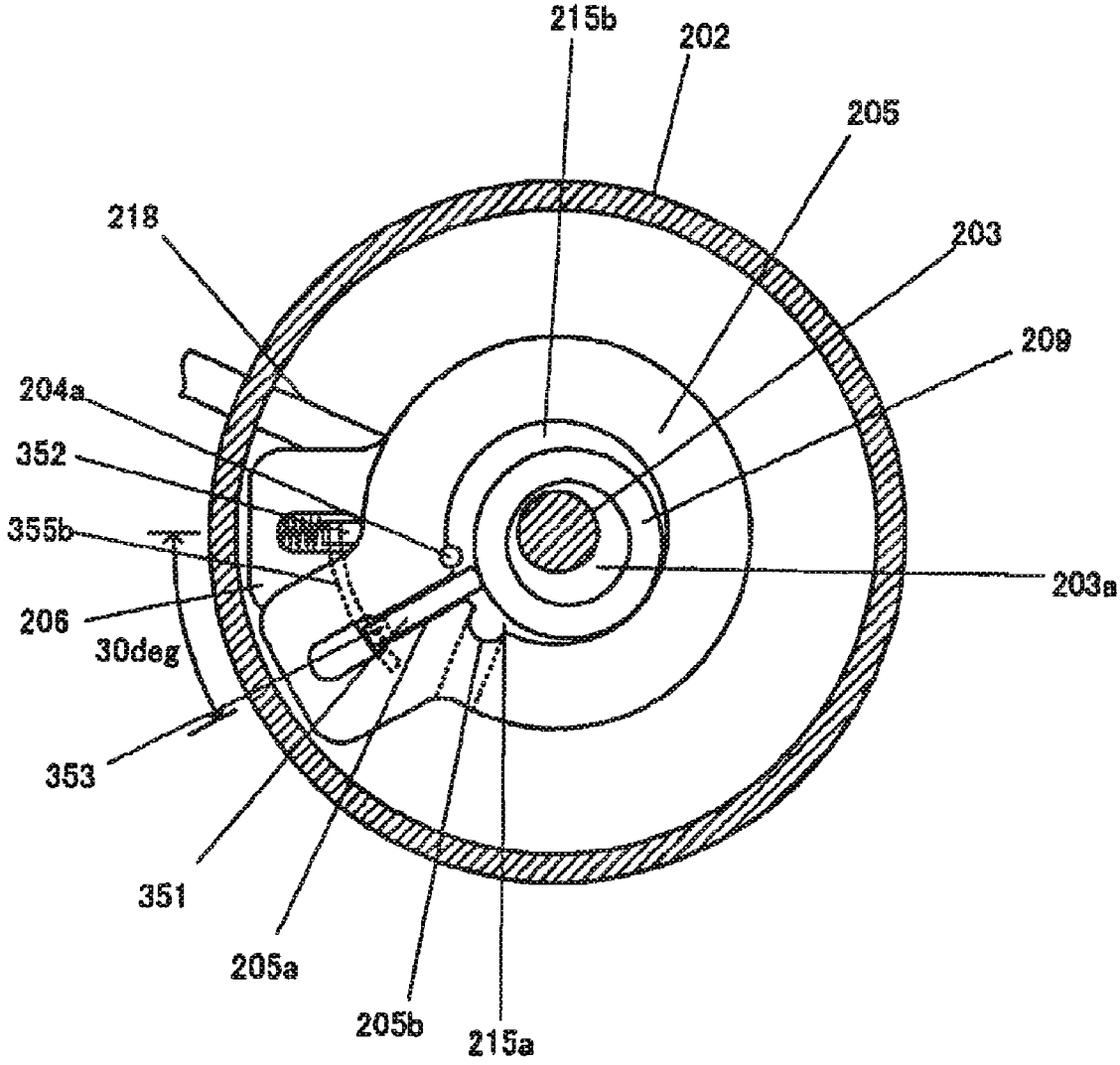
FIG. 11A is a horizontal cross-sectional view of the expander shown in FIG. 10, taken along line D4-D4.
Figure 11B:
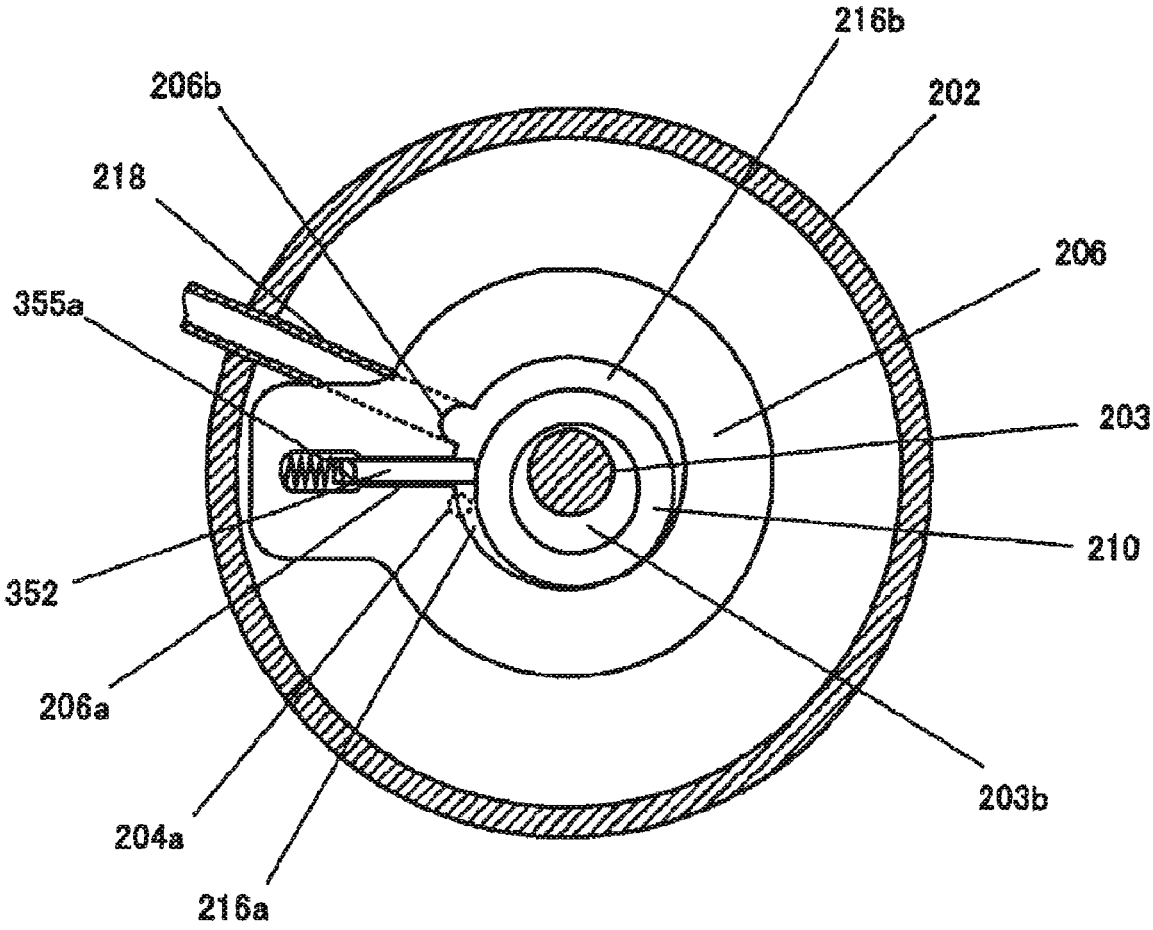
Figure 12A:
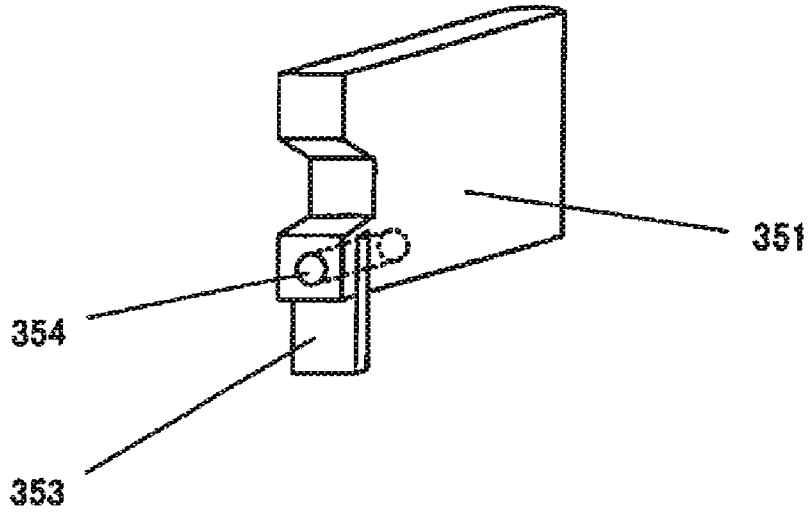
FIG. 12A is a perspective view illustrating a first vane of the expander shown in FIG. 10.
Figure 12B:
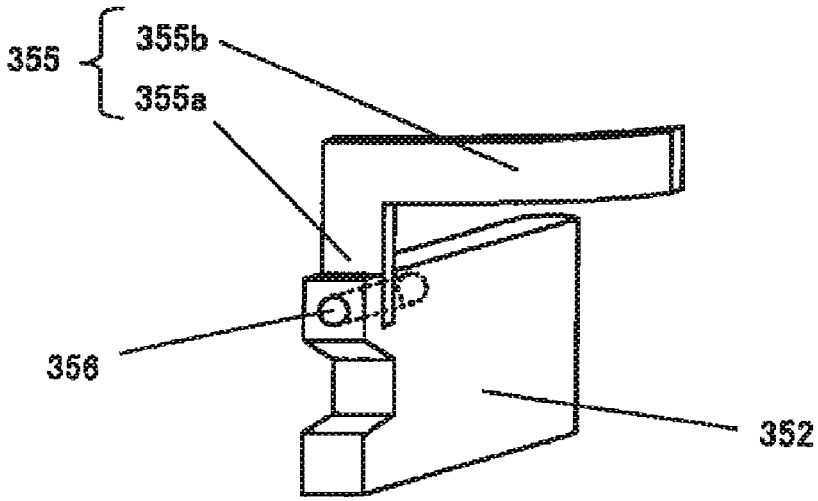
FIG. 12B is a perspective view illustrating a second vane of the expander shown in FIG. 10.
Figure 19:
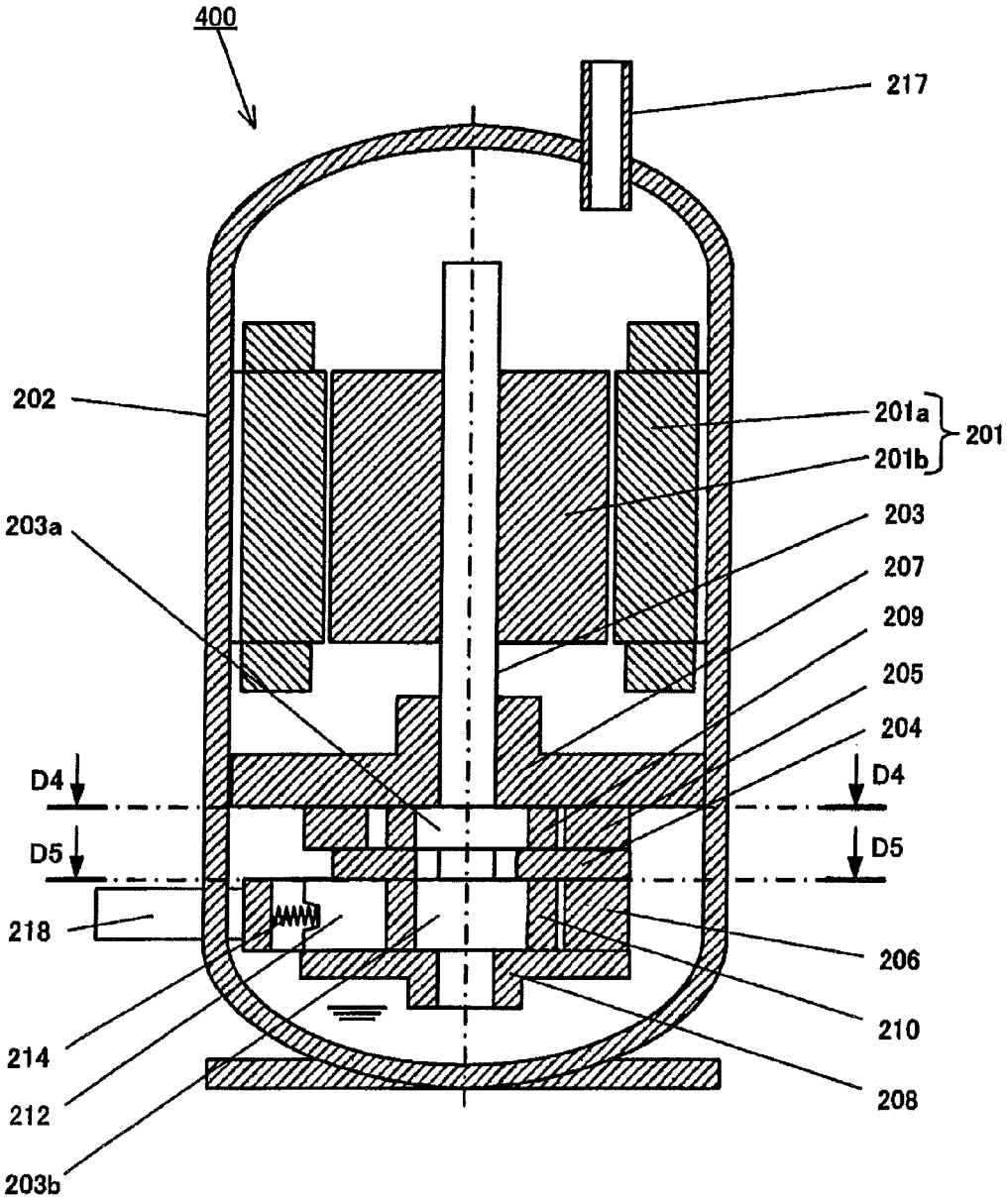
FIG.19 PRIOR ART
FIG. 19 is a vertical cross-sectional view illustrating a conventional expander.
Figure 20A:
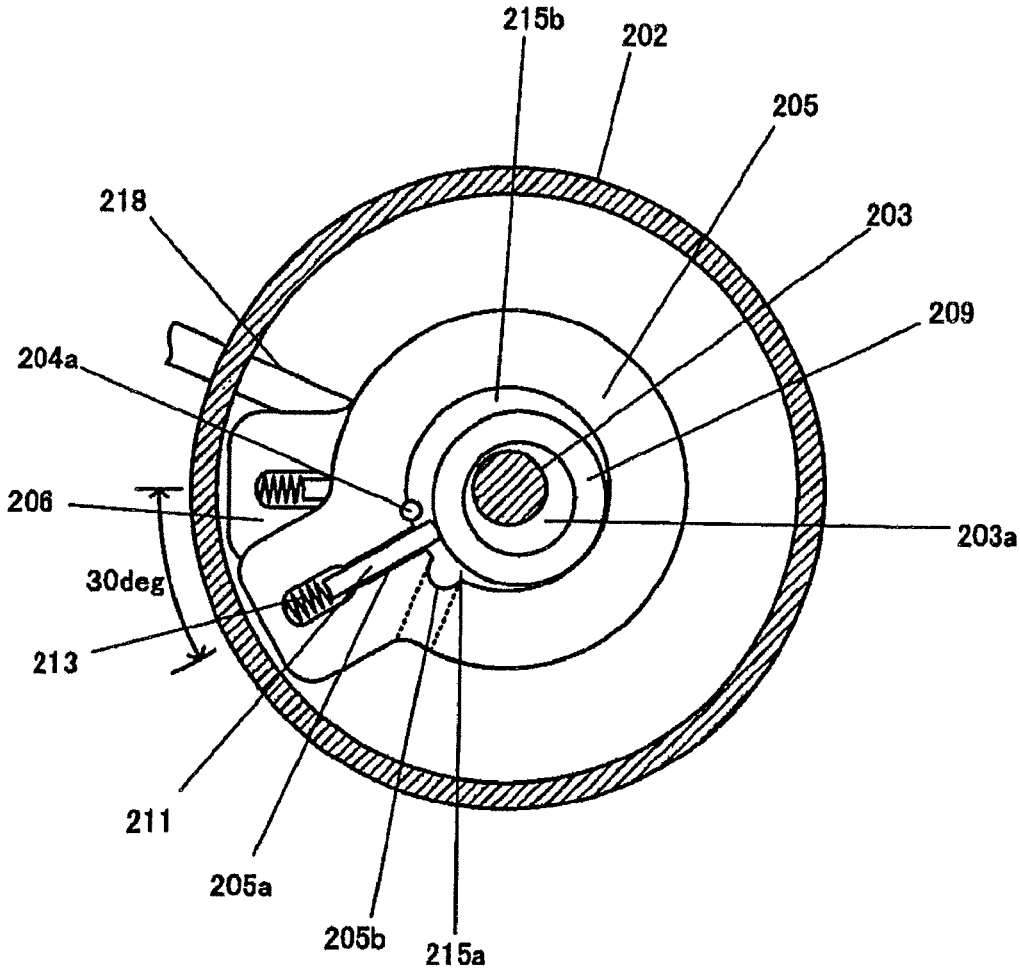
FIG.20A PRIOR ART
FIG. 20A is a horizontal cross-sectional view of the expander shown in FIG. 19, taken along line D4-D4.
Figure 20B:
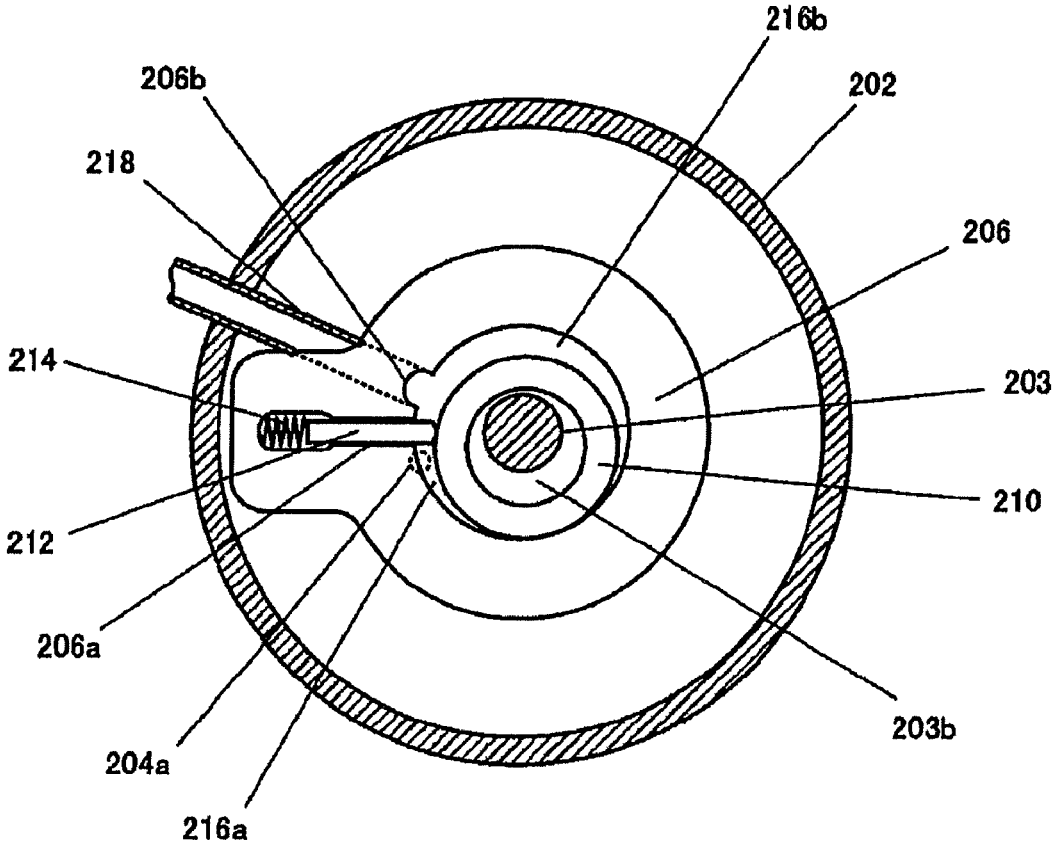
FIG.20B PRIOR ART
FIG. 20B is a horizontal cross-sectional view of the expander shown in FIG. 19, taken along line D5-D5.

FIG. 10 is a vertical cross-sectional view illustrating an expander 350 according to Embodiment 6 of the present invention. FIG. 11A is a horizontal cross-sectional view of the expander shown in FIG. 10, taken along line D4-D4. FIG. 11B is a horizontal cross-sectional view of the expander shown in FIG. 10, taken along line D5-D5. FIG. 12A is a perspective view illustrating a first vane of the expander shown in FIG. 10. FIG. 12B is a perspective view illustrating a second vane of the expander shown in FIG. 10. The configuration of the expander 350 of the present embodiment 6 is the same as that of the conventional rotary type expander 400 that has been illustrated with reference to FIGS. 19 and 20, in which the vane groove 205*a* of the first cylinder 205 and the vane groove 206*a* of the second cylinder 206 are in different rotational positions, except for the vanes and the intermediate plate. The same functional components are designated by the same reference numerals, and the descriptions of the same configurations and workings as those of the conventional examples will be omitted.

In the expander 350 of the present embodiment 6, the position of the vane groove 205*a* of the first cylinder 205 is rotated 30 degrees in the direction of rotation of the shaft 203 with respect to the position of the vane groove 206*a* of the second cylinder 206, and the amount of eccentricity of the first piston 209 and that of the second piston 210 are made equal to each other. A first vane 351 and a second vane 352 are disposed reciprocably in the vane groove 205*a* of the first cylinder 205 and the vane groove 206*a* of the second cylinder 206, respectively. As illustrated in FIG. 12A, a protruding portion 353 is fixed on the bottom face side of the first vane 351 by a pin 354 so that the protruding portion 353 it is fitted in a slit-like groove. In addition, as illustrated in FIG. 12B, a link member 355 as a transferring member for transferring a force acting on the second vane 352 to the first vane 351 is attached onto the upper face side of the second vane 352. The link member 355 is constituted by a seating portion 355*a* and a spring portion 355*b*. The link member 355 is fixed to a slit-like groove in the upper face of the second vane 352 by a pin 356 so that the seating portion 355*a* is fitted in the slit-like groove. The spring portion 355*b*, which constitutes a portion of the link member 355, is located between the first cylinder 205 and the second cylinder 206, as illustrated in FIG. 10. As illustrated in FIG. 11A, the spring portion 355*b* extends in an arc shape from the second vane 352 side toward the back side of the first vane 351, forming a shape that makes contact with the protruding portion 353 provided on the bottom face side of the first vane.

According to such a configuration, when the pistons 209, 210 move from the top dead center to the bottom dead center as the shaft 203 rotates, the second vane 352 is pushed toward the second piston 210 side due to the force resulting from the pressure difference between the interior and the exterior of the second cylinder 206 in addition to the force of the spring 214, and the leading end thereof is brought into contact with the second piston 210. At this time, the link member 355 fixed to the second vane 352 presses the protruding portion 353 of the first vane 351, whereby the first vane 351, on which the force resulting from the pressure difference does not act, also is pushed together with the second vane 352 toward the first piston 209 side. Here, the first vane 351 is at the position about 30 degrees shifted in the direction of rotation with respect to the second vane 352, viewed from the axis of the shaft 203. Accordingly, the first piston 209 reaches the top dead center at the position where the shaft 203 is rotated about 30 degrees from the position at which the second piston 210 reaches the top dead center.

In the present embodiment 6, the first vane 351 is at the position about 30 degrees shifted in the direction of rotation with respect to the second vane 352, viewed from the axis of the shaft 203, while the direction of eccentricity of the first piston 209 and that of the second piston 210 are the same. Therefore, the first piston 209 reaches the top dead center at the position where the shaft 203 is about 30 degrees rotated from the position at which the second piston 210 reaches the top dead center. Not only do the first vane 351 and the second vane 352 differ in the rotational positions of the vane grooves 205*a*, 206*a* but also in the timing at which they reach the top dead center, that is, the phase of the reciprocating motion. However, the link member 355 is located between the first cylinder 205 and the second cylinder 206 and includes the spring portion 355*b* extending from the second vane 352 toward the back side of the first vane 351. Therefore, the first vane 351, receiving a force from the second vane 352, is pushed even when the rotational positions of the vane grooves 205*a*, 206*a* are different. Furthermore, since the spring portion 355*b* undergoes elastic deformation both in the direction approaching the axis of the shaft 203 and in the direction moving away therefrom taking the seating portion 355*a* as the supporting point, it can absorb the phase difference in the reciprocating motion of the first vane 351 and the second vane 352. At this time, the second vane 352 reaches the top dead center earlier than the first vane 351, so the first vane 351 is elastically biased by the spring portion 355*b* and is pushed by the second vane 352.

Moreover, the direction of the vane groove 205*a* for the first vane 351 and the direction of the vane groove 206*a* for the second vane 352 are 30 degrees different. Accordingly, the distance from the seating portion 355*a* of the link member 355 of the second vane 352 to the protruding portion 353 of the first vane 351 changes in association with the reciprocating motion. However, since the spring portion 355*b* of the link member 355 and the protruding portion 353 of the first vane 351 slide over each other, the first vane 351 can be pushed by the second vane 352 smoothly. In this way, the link member 355 transfers the force acting on the second vane 352 to the first vane 351 while compensating the change in the relative positional relationship between the first vane 351 and the second vane 352. Thus, firm contact between the leading end of the first vane 351 and the first piston 209 can be ensured even when the vane groove 205*a* of the first cylinder 205 and the vane groove 206*a* of the second cylinder 206 are brought at different rotational positions. Accordingly, it becomes possible to prevent instable rotation of the shaft 203 and the failure to form the working chambers 215*a*, 215*b* of the expander due to the separation of the first vane 351 from the first piston 209, as well as the performance deterioration due to leakage of the working fluid. Thus, it becomes possible to provide a highly efficient expander capable of stable operations.

It is desirable that the link member 355 having the spring portion 355*b* be made of metal from the viewpoint of durability. For example, various stainless steels (SUS 302, 304, 316, 631, and so forth) that are suitable for springs are suitable as the material for the link member 355.

In the present embodiment, the position of the vane groove 205*a* of the first cylinder 205 is rotated 30 degrees in the direction of rotation of the shaft 203 with respect to the vane groove 206*a* of the second cylinder 206. It should be noted, however, that the same advantageous effects are obtained when the angle is within the range in which the vector of the reciprocating motion of the first vane 351 has a positive component with respect to the vector of the reciprocating motion of the second vane 352, that is within the range of from 0 degrees to 90 degrees. However, it is desirable that the angle be small to obtain more significant effects.

In the present embodiment, the amount of eccentricity of the first piston 209 and the amount of eccentricity of the second piston 210 are made equal to each other. However, because the link member 355 having the spring portion 355*b* is used, the same advantageous effects are exhibited even when the vane groove 205*a* of the first cylinder 205 and the vane groove 206*a* of the second cylinder 206 are oriented in different directions and the amount of eccentricity of the first piston 209 and the amount of eccentricity of the second piston 210 are not equal, as in Embodiment 5, specifically, when the amount of eccentricity of the first piston 209 is smaller than the amount of eccentricity of the second piston 210.

The present embodiment employs the configuration in which the link member 355 is provided on the second vane 352 and the spring portion 355*b* of the link member 355 presses the protruding portion 353 provided on the first vane 351. However, the same advantageous effects are obtained even when the configuration in which the link member is provided on the first vane 351 while the protruding portion is provided on the second vane 352 so that the protruding portion provided on the second vane 352 presses the spring portion of the link member.

(Embodiment 7)

Figure 13:
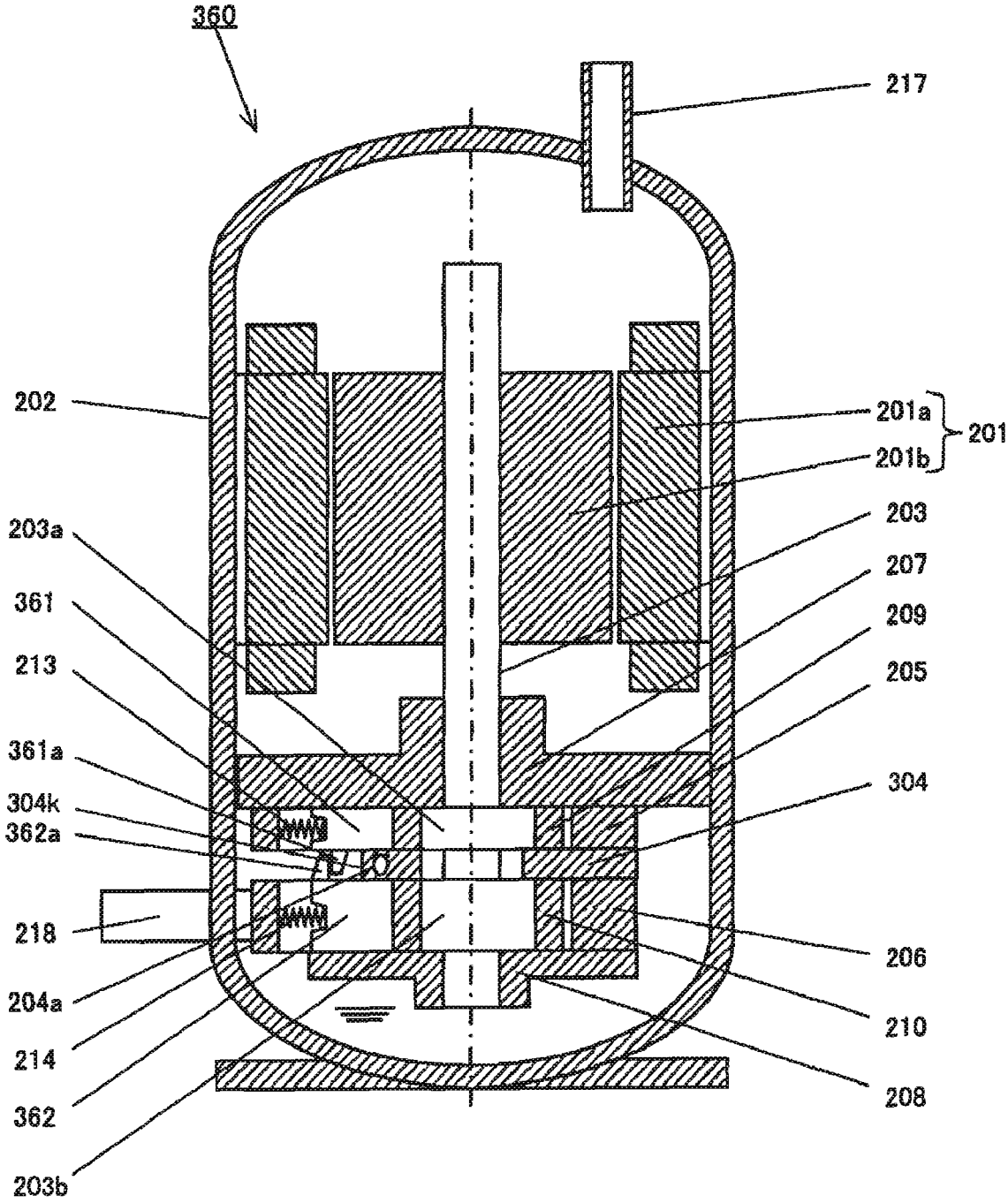
FIG. 13 is a vertical cross-sectional view illustrating an expander according to Embodiment 7 of the present invention.
Figure 14:
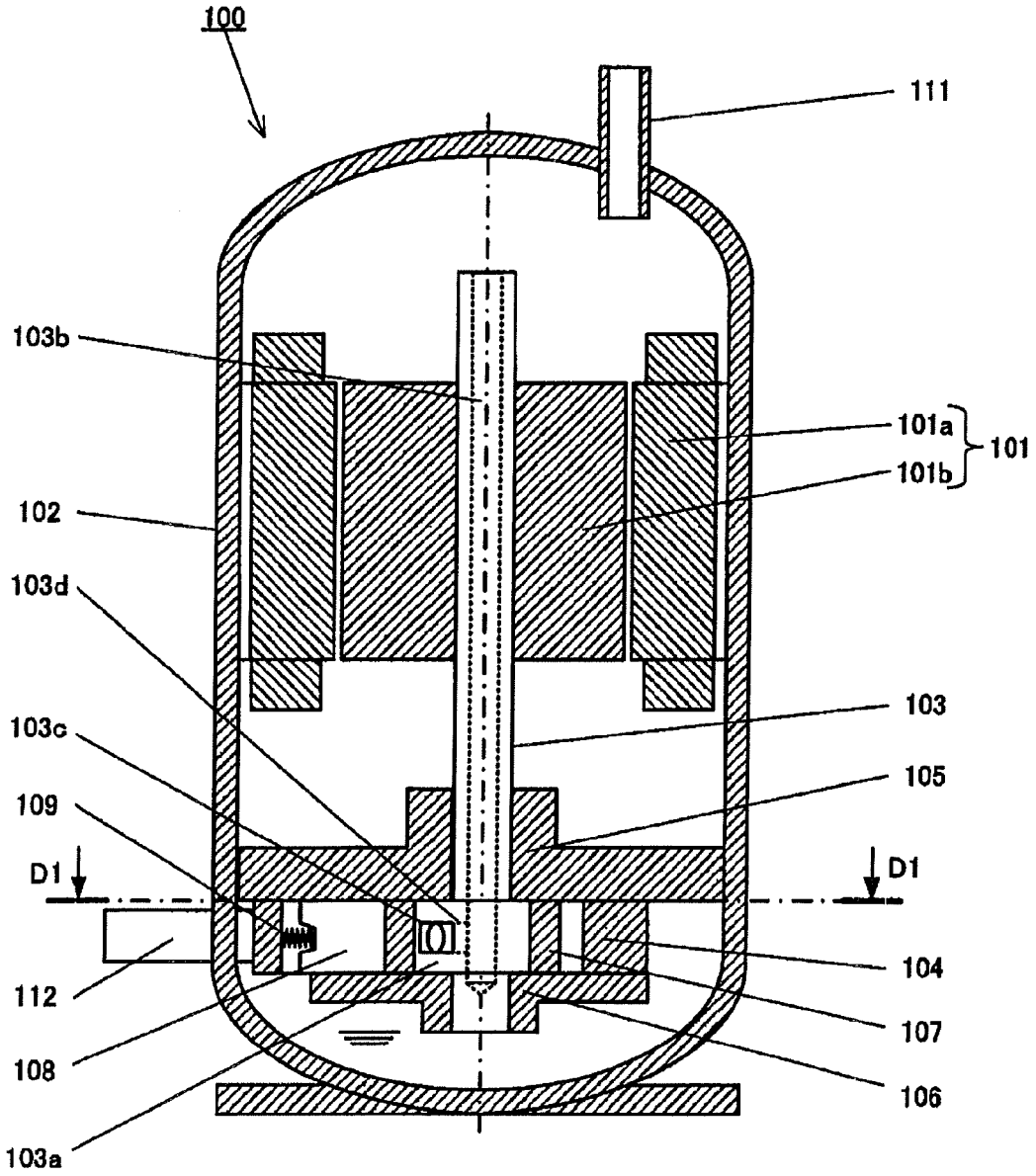
FIG.14 PRIOR ART
FIG. 14 is a vertical cross-sectional view illustrating a conventional expander.
Figure 15:
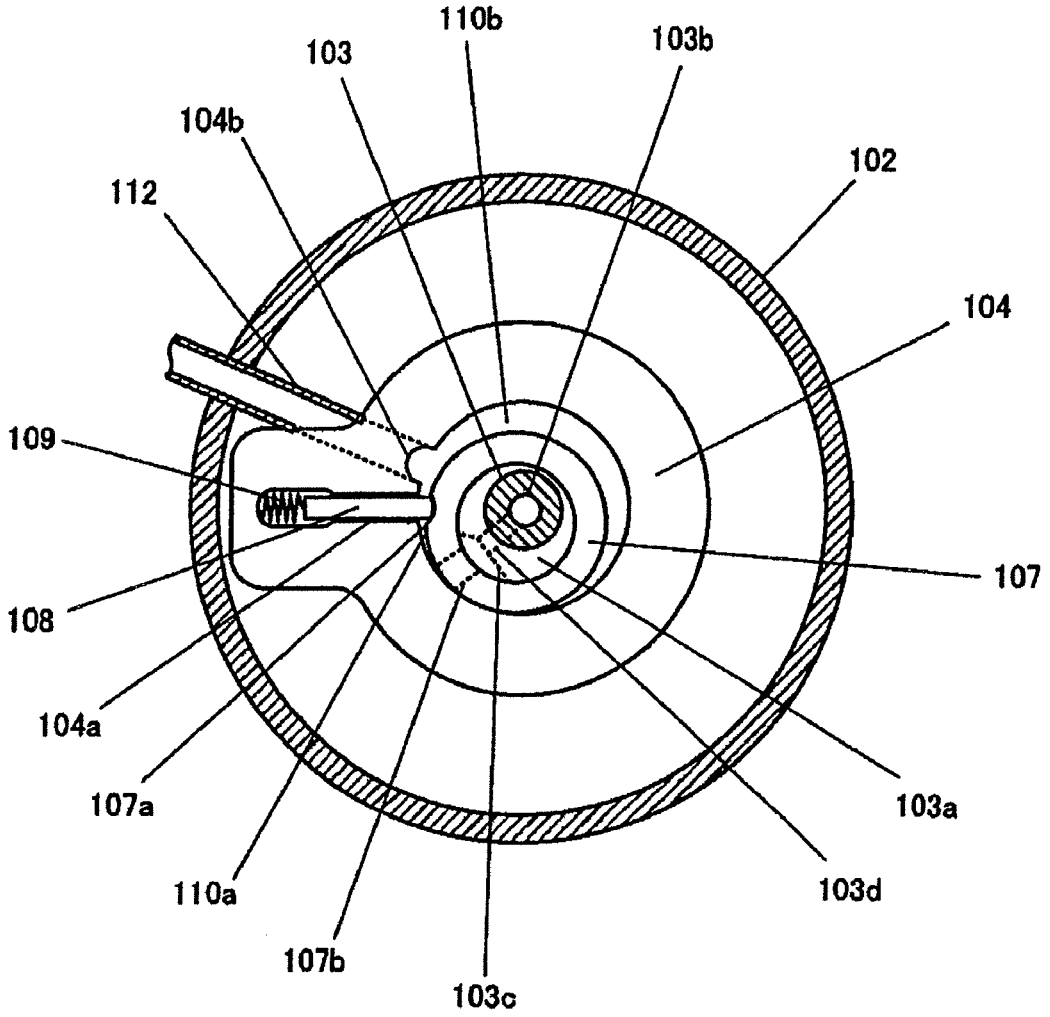
FIG.15 PRIOR ART
FIG. 15 is a horizontal cross-sectional view of the expander shown in FIG. 14, taken along line D1-D1.
Figure 16:
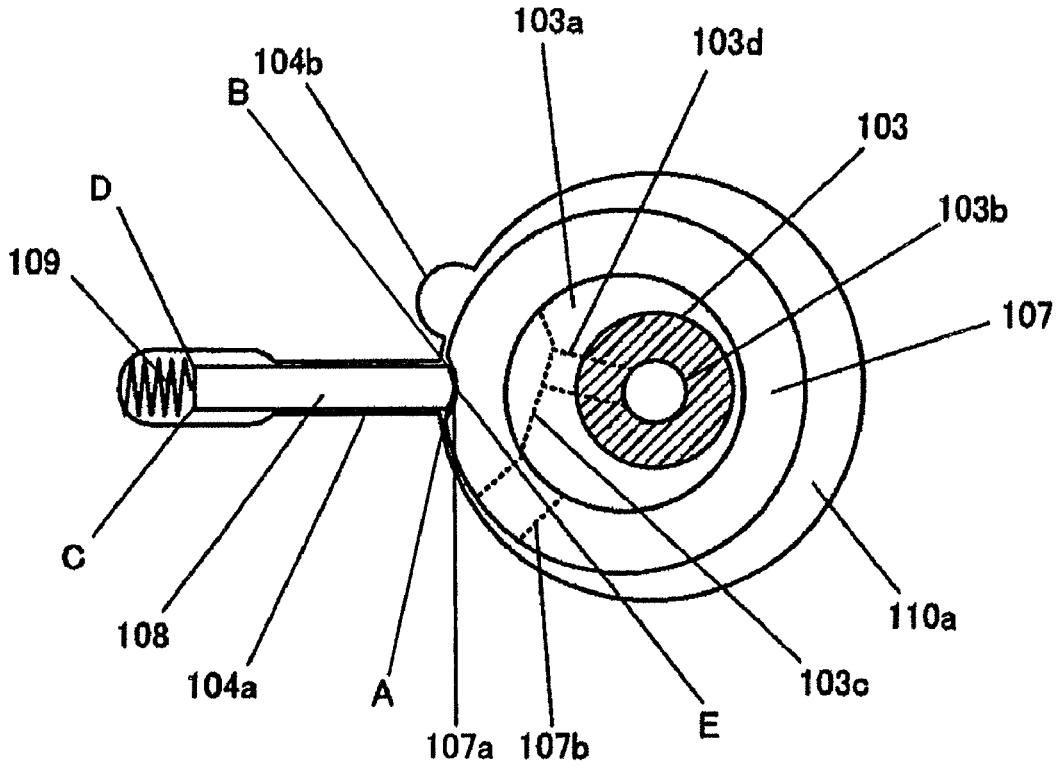
FIG.16 PRIOR ART
FIG. 16 is an enlarged horizontal cross-sectional view of the expander shown in FIG. 14, taken along line D1-D1.

FIG. 13 is a vertical cross-sectional view illustrating an expander 360 according to Embodiment 7 of the present invention. The configuration of the expander 360 of the present embodiment 7 is the same as that of the conventional rotary type expander 200 that has been illustrated with reference to FIGS. 17, 18, and 21, except for the vanes and the intermediate plate. The same functional components are designated by the same reference numerals, and the descriptions of the same configurations and workings as those of the conventional examples will be omitted.

In the expander 360 of the present embodiment 7, the direction of eccentricity and the amount of eccentricity of the first piston 209 and those of the second piston 210 with respect to the shaft 203 are made equal to each other. A first vane 361 and a second vane 362 are disposed reciprocably in the vane groove 205*a* of the first cylinder 205 and the vane groove 206*a* of the second cylinder 206, respectively. A protruding portion 361*a* and a protruding portion 362*a* are provided on the lower face of the first vane 361 and the upper face of the second vane 362, respectively. The protruding portions 361*a*, 362*a* are brought into contact with each other so that the protruding portion 362*a* of the second vane 362 can press the protruding portion 361*a* of the first vane 361.

According to such a configuration, when the pistons 209, 210 move from the top dead center to the bottom dead center as the shaft 203 rotates, the second vane 362 is pushed toward the second piston 210 side due to the force resulting from the pressure difference between the interior and the exterior of the second cylinder 206 in addition to the force of the spring 214, and the leading end thereof is brought into contact with the second piston 210. At this time, the first vane 361, on which the force resulting from the pressure difference does not act, also is pushed together with the second vane 362 toward the first piston 209 side by the protruding portion 362*a* via the protruding portion 361*a*. Thus, firm contact between the leading end of the first vane 361 and the first piston 209 can be ensured. Accordingly, it becomes possible to prevent instable rotation of the shaft 203 and the failure to form the working chambers 215*a*, 215*b* of the expander due to the separation of the first vane 361 from the first piston 209, as well as the performance deterioration due to leakage of the working fluid. Thus, it becomes possible to provide a highly efficient expander capable of stable operations.

Moreover, because the force is transferred between the protruding portion 361*a* of the first vane 361 and the protruding portion 362*a* of the second vane 362, the size of the protruding portion 362*a* of the second vane 362 can be smaller than the cases of Embodiments 1 through 6. Accordingly, the moment acting on the second vane 362 due to the reaction to the pressing force of the protruding portion 362*a* acting on the first vane 361 can be reduced. Therefore, it becomes possible to prevent the second vane 362 from tilting by the moment, which causes the second vane 362 to twist between the intermediate plate 304 and the bearing 208, which cover the top and bottom of the vane groove 206*a* of the second cylinder 206. Thus, a highly reliable expander can be provided.

The multi-stage rotary type expander of the present invention that has been described thus far is useful as a mechanical power recovery apparatus for recovering the energy of expansion of a refrigerant in a refrigeration cycle, as well as an energy recovery apparatus for recovering energy from a compressible fluid other than refrigerants (e.g., a vapor).

Although the present specification has described several embodiments of an expander in which one expansion chamber is formed by two stages of cylinders as an example, the subject matter of the present invention may also be employed suitably to an expander in which a plurality of expansion chambers are formed by three or more stages of cylinders and a refrigerant is expanded step by step using the plurality of expansion chambers.

The invention claimed is:

1. A multi-stage rotary type expander comprising:

a shaft having a first eccentric portion and a second eccentric portion vertically along its axis;

a first piston attached to the first eccentric portion and performing eccentric rotational motion;

a first cylinder disposed such that a portion of an inner surface thereof is in contact with the first piston;

a first vane disposed reciprocably in a first vane groove provided in the first cylinder, the first vane dividing, by a leading end thereof being in contact with the first piston, a space between the first cylinder and the first piston into a first intake-side space and a first discharge-side space;

a second piston attached to the second eccentric portion and performing eccentric rotational motion;

a second cylinder disposed such that a portion of an inner surface thereof is in contact with the second piston;

a second vane disposed reciprocably in a second vane groove provided in the second cylinder, the second vane dividing, by a leading end thereof being in contact with the second piston, a space between the second cylinder and the second piston into a second intake-side space and a second discharge-side space, and receiving a force toward the second piston produced by a high-pressure atmosphere outside the second cylinder;

an intake passage for allowing a working fluid before expansion to be taken into the first intake-side space;

a connecting passage for forming a working chamber, the connecting passage connecting the first discharge-side space and the second intake-side space, wherein the working fluid expands in the working chamber; and a discharge passage for allowing the working fluid after expansion to be discharged from the second discharge-side space, wherein the second vane applies to the first vane a force in a direction toward the first piston when the second vane moves toward the second piston side, the first vane and the second vane are constituted by separate components, and their relative positional relationship is permitted to be varied, the multi-stage rotary type expander further comprises a transferring member for transferring a force acting on the second vane to the first vane to link a movement of the first vane to a movement of the second vane, the transferring member is a coupling member for coupling the first vane and the second vane, and the coupling member is movable in a direction perpendicular to a direction of reciprocating motion of the first vane.

2. The multi-stage rotary type expander according to claim 1, wherein at least a portion of the coupling member is an elastic body.

3. The multi-stage rotary type expander according to claim 2, wherein the elastic body is disposed between the first cylinder and the second cylinder with respect to a direction parallel to the axis of the shaft.

4. The multi-stage rotary type expander according to claim 1, wherein the transferring member transfers the force acting on the second vane to the first vane while absorbing a variation in the relative positional relationship between the first vane and the second vane.

5. The multi-stage rotary type expander according to claim 4, wherein at least a portion of the transferring member is elastically deformable, and the first vane is elastically biased by the portion of the transferring member.

6. The multi-stage rotary type expander according to claim 5, wherein an amount of eccentricity of the first piston is smaller than an amount of eccentricity of the second piston.

7. The multi-stage rotary type expander according to claim 5, wherein a rotational position of the first vane groove and a rotational position of the second vane groove are different from each other.

8. A refrigeration cycle apparatus comprising:

a compressor for compressing a refrigerant;

a radiator for cooling the refrigerant compressed by the compressor;

an expander for expanding the refrigerant cooled by the radiator; and an evaporator for evaporating the refrigerant expanded by the expander, wherein the expander comprises the multi-stage rotary type expander according to claim 1.

9. A multi-stage rotary type expander comprising:

a shaft having a first eccentric portion and a second eccentric portion vertically along its axis;

a first piston attached to the first eccentric portion and performing eccentric rotational motion;

a first cylinder disposed such that a portion of an inner surface thereof is in contact with the first piston;

a first vane disposed reciprocably in a first vane groove provided in the first cylinder, the first vane dividing, by a leading end thereof being in contact with the first piston, a space between the first cylinder and the first piston into a first intake-side space and a first discharge-side space;

a second piston attached to the second eccentric portion and performing eccentric rotational motion;

a second cylinder disposed such that a portion of an inner surface thereof is in contact with the second piston;

a second vane disposed reciprocably in a second vane groove provided in the second cylinder, the second vane dividing, by a leading end thereof being in contact with the second piston, a space between the second cylinder and the second piston into a second intake-side space and a second discharge-side space, and receiving a force toward the second piston produced by a high-pressure atmosphere outside the second cylinder;

an intake passage for allowing a working fluid before expansion to be taken into the first intake-side space;

a connecting passage for forming a working chamber, the connecting passage connecting the first discharge-side space and the second intake-side space, wherein the working fluid expands in the working chamber; and a discharge passage for allowing the working fluid after expansion to be discharged from the second discharge-side space, wherein the second vane applies to the first vane a force in a direction toward the first piston when the second vane moves toward the second piston side, the first vane and the second vane form one end and the other end, respectively, of a U-side vane made of a single component, and their relative positional relationship is invariable, and the leading end of the first vane and the leading end of the second vane are aligned such that a distance from the leading end of the first vane to the axis of the shaft is equal to a distance from the leading end of the second vane to the axis of the shaft at all times.

10. A refrigeration cycle apparatus comprising:

a compressor for compressing a refrigerant;

a radiator for cooling the refrigerant compressed by the compressor;

an expander for expanding the refrigerant cooled by the radiator; and an evaporator for evaporating the refrigerant expanded by the expander, wherein the expander comprises the multi-stage rotary type expander according to claim 9.

* * * * *